US011505990B2

(12) United States Patent
Papadopoulos

(10) Patent No.: US 11,505,990 B2
(45) Date of Patent: Nov. 22, 2022

(54) AUTONOMOUS ANTI-MOSQUITO NET SYSTEM FOR A FIXED LOWER GUIDE

(71) Applicant: Argyrios Papadopoulos, Veroia (GR)

(72) Inventor: Argyrios Papadopoulos, Veroia (GR)

( * ) Notice: Subject to any disclaimer, the term of this patent is extended or adjusted under 35 U.S.C. 154(b) by 33 days.

(21) Appl. No.: 16/623,615

(22) PCT Filed: Feb. 26, 2018

(86) PCT No.: PCT/GR2018/000009
§ 371 (c)(1),
(2) Date: Dec. 17, 2019

(87) PCT Pub. No.: WO2019/162709
PCT Pub. Date: Aug. 29, 2019

(65) Prior Publication Data

US 2020/0115957 A1 Apr. 16, 2020

(51) Int. Cl.
*E06B 9/58* (2006.01)
*E06B 9/52* (2006.01)
*E06B 9/54* (2006.01)

(52) U.S. Cl.
CPC ..... *E06B 9/522* (2013.01); *E06B 9/58* (2013.01); *E06B 2009/543* (2013.01); *E06B 2009/583* (2013.01)

(58) Field of Classification Search
CPC ... E06B 9/54; E06B 9/58; E06B 9/522; E06B 2009/543; E06B 2009/2625; E06B 2009/583
See application file for complete search history.

(56) References Cited

U.S. PATENT DOCUMENTS 4,673,018 A * 6/1987 Judkins ..... E06B 9/262 160/168.1 R
5,351,737 A * 10/1994 Hoshiyama ..... E06B 9/262 160/84.03

(Continued)

FOREIGN PATENT DOCUMENTS

EP 0549209 A1 * 6/1993 ..... E06B 9/262
EP 1903175 A2 * 3/2008 ..... E06B 9/52

(Continued)

OTHER PUBLICATIONS

European Patent Office, International Search Report in International Patent Application No. PCT/GR2018/000009, 3 pp. (dated Mar. 22, 2019).

(Continued)

*Primary Examiner* — Daniel P Cahn
*Assistant Examiner* — Abe Massad
(74) *Attorney, Agent, or Firm* — Leydig, Voit & Mayer, Ltd.

(57) ABSTRACT

The system has a pleated net run by ropes that begin from the same side of the retention case, cross the net and continue upwards to all upper fixed horizontal guide, and are fastened at the upper part of the system. This invention uses wire rope which has one edge fastened at the upper truck, passes horizontally above the net, then parses through the pulley at the upper part of the sliding case, follows a vertical course towards the second pulley at the lower part of the sliding guide, crosses the lower fixed horizontal guide and is fastened on the lower part of the vertical fixed side guide. In case of a system with two or more leaves, this invention uses a ropes' central end component, tension adjusters and a ropes' run component.

4 Claims, 14 Drawing Sheets

(56) References Cited

U.S. PATENT DOCUMENTS

Figure 1:
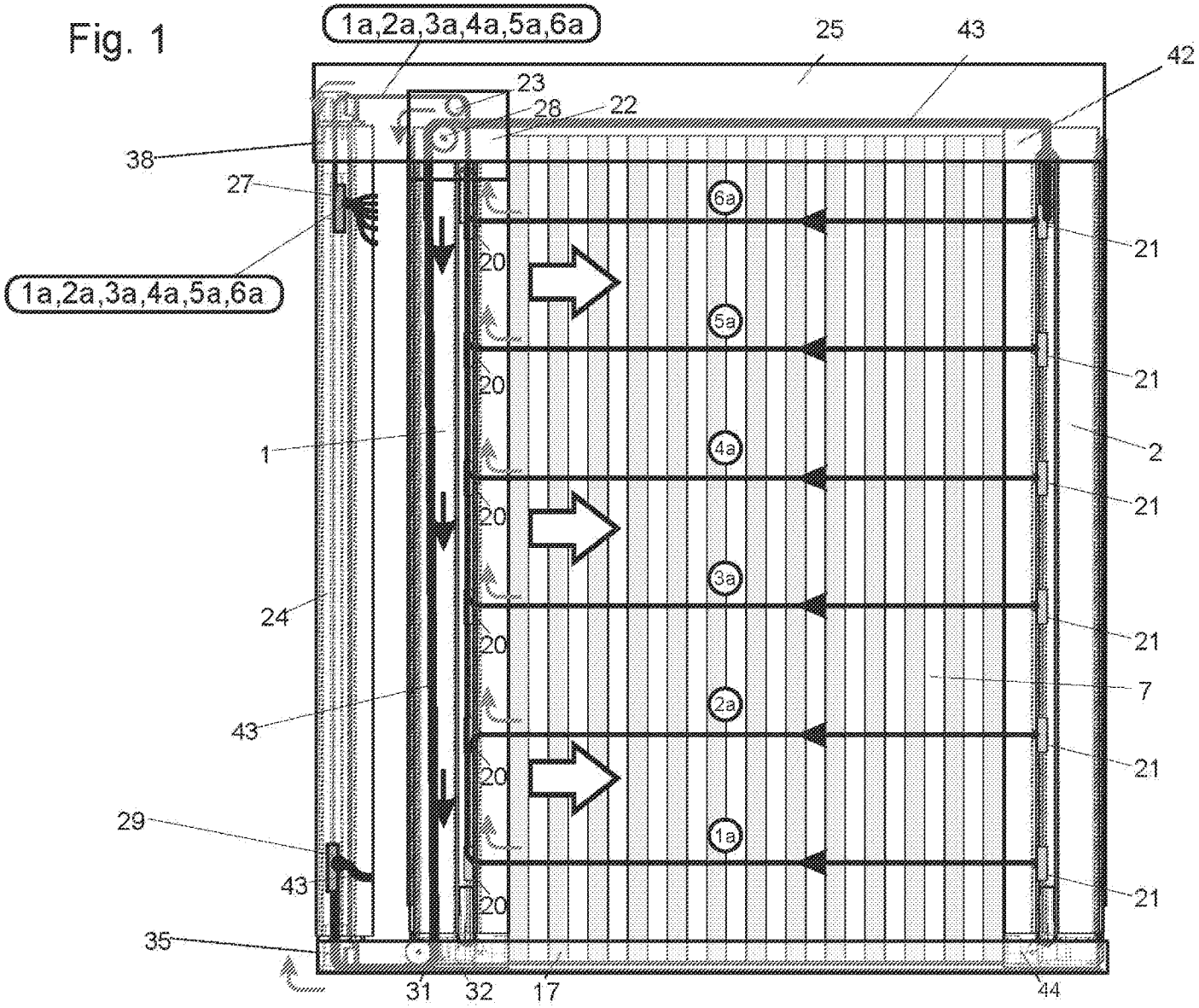

| | | | | | |
|---|---|---|---|---|---|
| 5,377,737 | A * | 1/1995 | Moriya | E05F 1/025 | 160/190 |
| 7,730,926 | B2 * | 6/2010 | Moriya | E06B 9/52 | 160/84.06 |
| 7,984,744 | B2 * | 7/2011 | Karasawa | E06B 9/522 | 160/84.06 |
| 8,082,969 | B2 * | 12/2011 | Okachi | E06B 9/262 | 160/84.06 |
| 2007/0039698 | A1 * | 2/2007 | Chino | E06B 9/54 | 160/84.06 |

FOREIGN PATENT DOCUMENTS

| | | | | | |
|---|---|---|---|---|---|
| EP | 2025858 | A2 * | 2/2009 | E06B 9/522 | |
| EP | 2085562 | A2 * | 8/2009 | E06B 9/54 | |
| EP | 0999335 | B3 * | 8/2011 | E06B 9/54 | |
| EP | 2034123 | A4 * | 1/2012 | E06B 9/262 | |
| EP | 2436870 | A2 * | 4/2012 | E06B 9/54 | |
| EP | 1653038 | B1 * | 2/2013 | E06B 9/52 | |
| EP | 2681393 | B1 * | 3/2015 | E06B 9/522 | |
| EP | 2986802 | B1 * | 7/2017 | E06B 9/522 | |
| EP | 2157274 | B1 * | 8/2020 | E06B 9/262 | |
| WO | WO-2013124695 | A1 * | 8/2013 | E06B 9/58 | |
| WO | WO 2014/170702 | A1 | 10/2014 | | |
| WO | WO 2015/079267 | A1 | 6/2015 | | |
| WO | WO-2020146922 | A1 * | 7/2020 | E06B 9/54 | |

OTHER PUBLICATIONS

European Patent Office, Written Opinion in International Patent Application No. PCT/GR2018/000009, 5 pp. (dated Mar. 22, 2019).

* cited by examiner

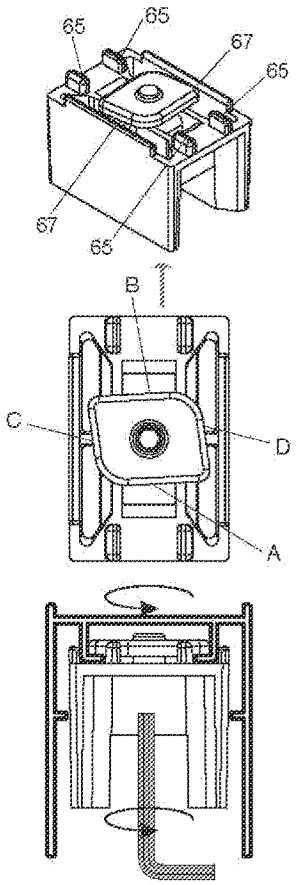
Fig. 7d
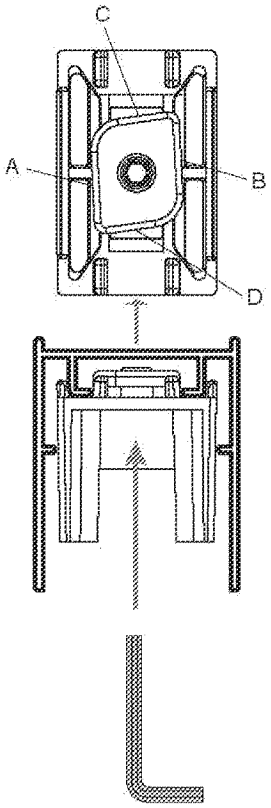
Fig. 7c
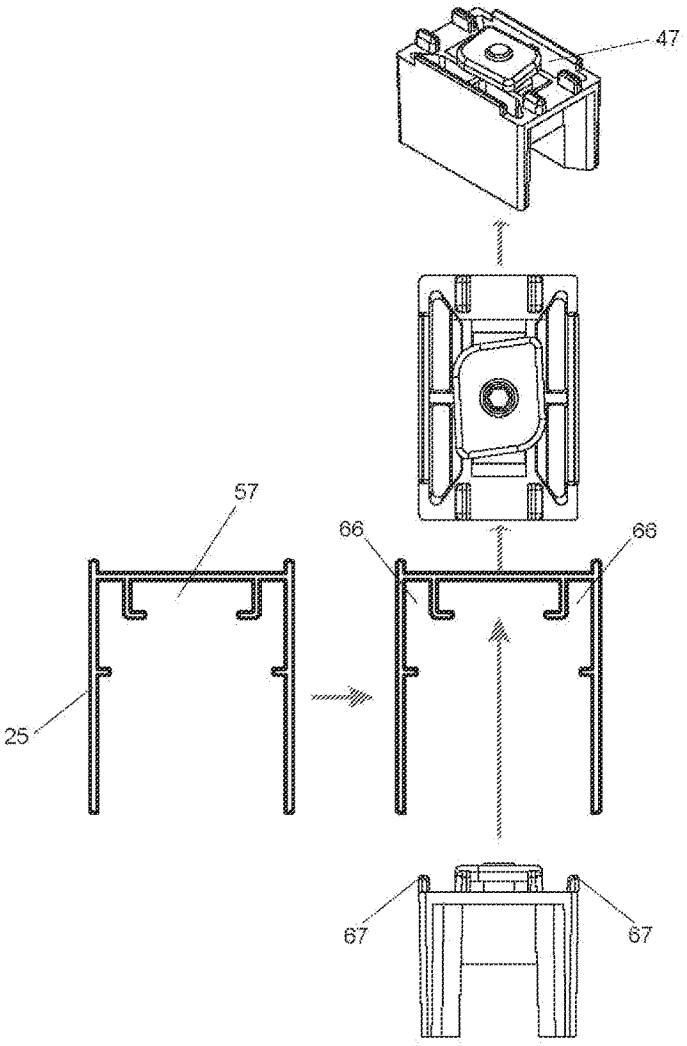
Fig. 7b
Fig. 7a

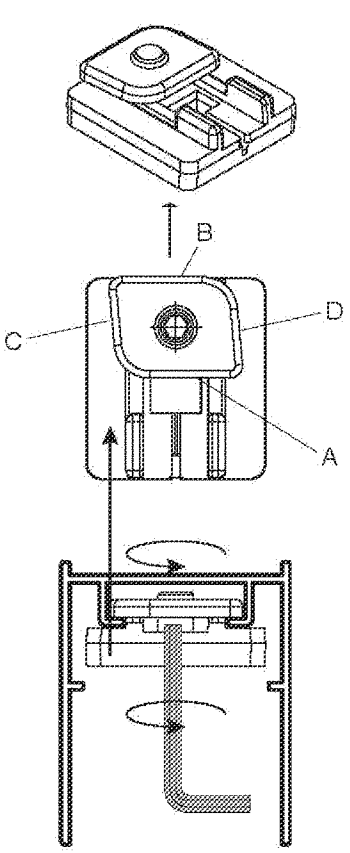
Fig. 9d
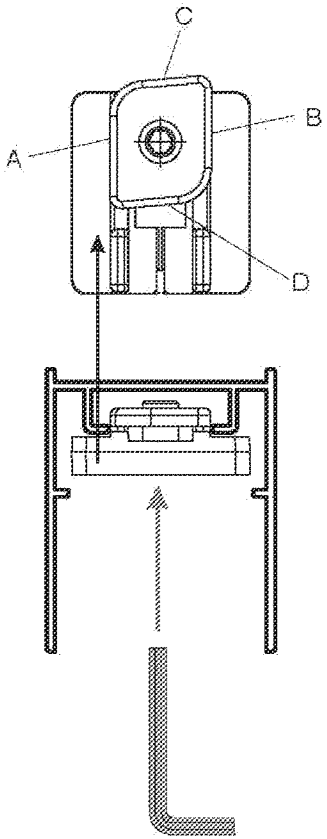
Fig. 9c
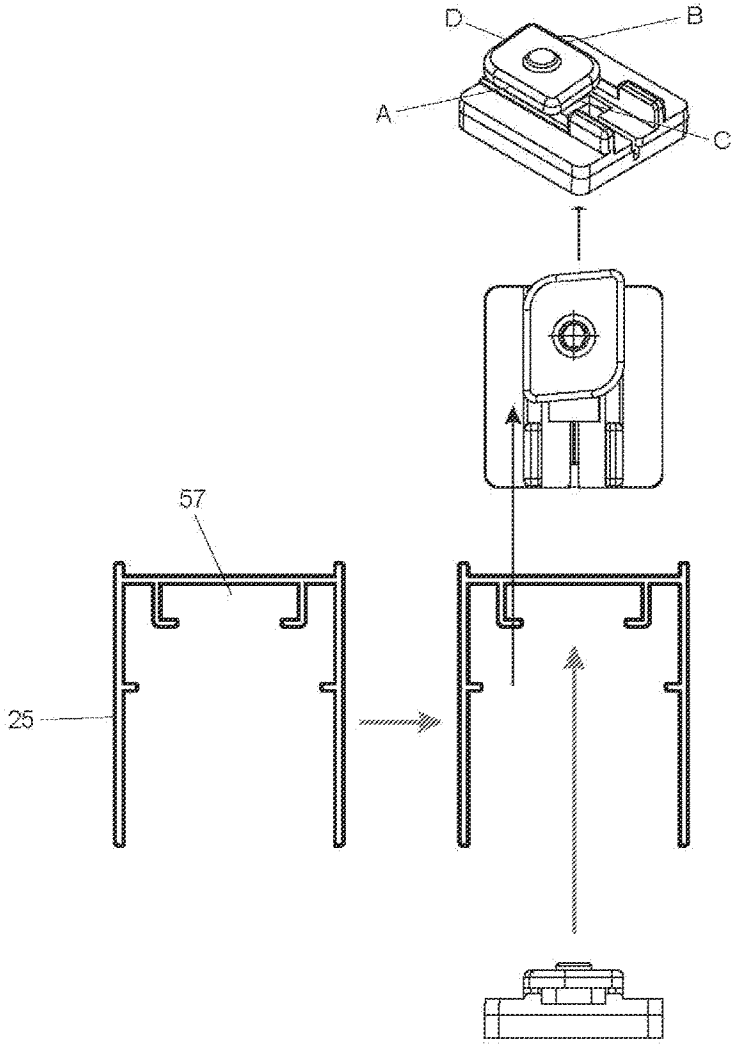
Fig. 9b
Fig. 9a 1a,2a,3a,4a,5a,6a
1b,2b,3b,4b,5b,6b
25
49
49a
47
57

AUTONOMOUS ANTI-MOSQUITO NET SYSTEM FOR A FIXED LOWER GUIDE

CROSS-REFERENCE TO RELATED APPLICATIONS

This patent application claims priority to International Patent Application No. PCT/GR2018/000009, which was filed on Feb. 26, 2019, and which is incorporated by reference herein in its entirety.

FIELD OF THE DISCLOSURE

The invention belongs to the field of mechanics of anti-mosquito net systems that are used for horizontal door sliding.

BACKGROUND OF THE INVENTION

According to the current state of the art, systems use mainly anti-mosquito net (screen) which is pleated, that is it has pleats in its fabric, so that the net can be folded and unfolded. The present invention concerns anti-mosquito systems with such pleated net (with pleats).

According to the current state of the art, these systems resemble a frame, which has two vertical sides, two cases: the retention case and the sliding case. The retention case is fixed, fastened and firmly attached to the one vertical side of the frame of the opening. At the same time, a fixed side guide is fastened and firmly attached to the opposite vertical side of the frame of the opening. The sliding case is movable, it moves with a direction from the retention case towards the fixed side guide and vice versa, and at a position always parallel to those two parts. The pleated net is folded in pleats (frill), between the two vertical cases, the fixed retention case and the movable sliding case.

As two horizontal sides, up and down, the frame has on the top part a straight horizontal permanent guide and on the bottom part has either a second straight horizontal permanent guide, or an articulated guide.

One problem that appears in the current state of the art is that the ropes that run through the net and run across the bottom guide of the system, often due to usage and passing of the users are cut. Their replacement is arduous, as it requires the removal of the net and its return to the producer for repair and replacement of the cut net.

Another technical problem of the current state of the art is that had the dimensions of height of the retention case, the sliding, case and the vertical side guide not been measured correctly, the entire anti-mosquito system is useless, the dimensions have to be measured again and a new system to be ordered again. That happens because during its placement the system is a single technical element, a ready-made frame of four sides, which was made according to the specific dimensions of the order and is fastened at the particular opening for which it has been ordered. The anti-mosquito system that has been cut and assembled according to wrong dimensions, especially the height of the vertical side guide and the two cases (only a miscalculation of the order of ±1 mm is forgiven) cannot be fixed, nor is there a possibility to substitute any of its components. The above technical problems aim to solve EP 0549209, EP 1903175 and EP 0999335, but without providing the possibility of correcting wrong dimensions.

One last problem is that the ropes used by the systems of the present state of the art are fastened to the system with components which allow the movement of the nets of the anti-mosquito system only up to a point where these components reach and meet the guides, so the movement of the ropes is terminated. For this reason, these systems present a technical problem, that is, if the width of the frame exceeds its height, the leaves do not open completely, but only to the point where the rope following the movement of the net and the frame "terminates" with the component inside the guide and stops the system. Therefore, these systems cannot be used to cover openings that are larger than its height.

EP 1653038 aims also at solving the aforementioned technical problems; in EP 1653038, however, as opposed to the current invention, the two horizontal guides of the system, the top and the bottom ones, do not have any independence. Neither the top guide nor the two end parts can be detached from the retention and the sliding cases without the dismantling of the whole system. If they are detached, the two retention ropes will be detached and then the bottom guide will be disassembled, as well as the bottom ends that are restrained by the bottom rope of retention and therefore the whole system.

There are also solutions that allow the correction of wrong dimensions by using a kit, as they are presented in the pending applications GR 20100100552 (EP11386006.8) and GR 20110100129 (PCT/GR2011/000016), but this is done in a different way to the present invention. Specifically, in GR 20100100552 (EP11386006.8) for the overcome of this technical problem an additional component is used, a height regulator, a component which is not needed in the current invention while in GR 20110100129 (PCT/GR2011/000016) two articulated guides are used, the top and the bottom ones, placed diagonally, while the current inventive idea uses no articulated guide.

A kit solution is recommended also by the EP 2157274 A2 and EP 1653038. However these two solutions present significant differences to the present invention, as they utilize components which are not necessary for this invention, as, for example, a support, a spiral spring; also, the articulated guide is not fastened neither on the sliding case nor on the retention case (EP 2157274) etc., and they present a completely different arrangement of ropes as opposed to the present invention with the use of many springs (EP 1653038 A2).

A solution to the above technical problems is also recommended by EP2034123 A1, where however, the use of additional technical means is presented as a technical difference with the current invention. Such means are the components with pulley which are screwed on the net on both its sides in order to direct the ropes, while the present invention does not have components with pulleys on the net. Moreover, end components are utilized where all the ropes end up on both of their end points, while in the present invention not all the ropes end up on them but just a few of them, and finally in EP2034123 an independent net system is presented which require two articulated guides, at the top and the bottom, in order to function properly, whereas on the contrary, the current invention at the top has a fixed horizontal top guide and at the bottom could have whichever type of bottom guide, either fixed or articulated.

Solution to the above technical problems is also recommended by the no. PCT/GR2012/000009 which nevertheless presents some technical differences from the present disclosure: The end of the articulated guide which is located within the retention case is not fastened at any point. As a consequence of that when the sliding case is driven towards the opposite vertical fixed side and unfolds the net, it is easy for the guide to come off from the retention case because it is pulled out by the bundle of the ropes which are fastened on it. But when the opposite movement is performed and the sliding case is directed towards the retention case folding the net, then there is no counterweight which will exert the opposite attraction and will pull off the end of the articulated guide and will direct it again back inside the retention case.

A solution is also meant to be given by the EP2025858A2 but there an extra component of spring is used to which is directed and fastened the bundle of the ropes, while the present invention does not utilize such a component. Also, a similar solution is suggested by EP 2157274 A2, where a step component is used, while the present invention does not use such a component.

Finally, a solution is proposed by implementing WO 2015/079267, which however uses an articulated guide at its lower part, in contrast to this invention, which uses no such articulated guide, only simple guides at the upper and lower parts. The system, that WO 2015/079267 presents, fails to solve the aforementioned problem where the width of the opening must necessarily be less than its height as it uses an end ropes component on which all the ropes are tied and which when stopped at the top pulleys or the lower pulley of the system, cannot pass through the pulleys because of its size, thus ending the movement of the pleats and immobilizing the system. Alternatively, it ties the ropes to an articulated guide. In addition, the system proposed in WO 2015/079267 is difficult to be mounted and assembled due to the several pulleys throughout the system—four at the upper part of the slide guide—and the accessories, as well as due to the fact that the ropes must be tied on the end component or an articulated guide and be regulated one by one. It is also unstable, a problem which may be solved if all the pleats open only from one side, whereas the other side will be fixed on the frame without being opened.

BRIEF SUMMARY OF THE INVENTION

The present invention refers to systems using at their bottom part a straight permanent guide, not an articulated guide.

The folding and unfolding of the pleated net is mainly done with the help of the ropes running the cloth, which start from one vertical case (in some systems) or both vertical cases facing each other, divided into groups (in some other systems), and crossing the lower guide of the system, whereas their ends are tied to the vertical fixed side guide at the top and bottom of the system. As the sliding case moves, the ropes unfold or fold with its movement, thereby helping the pleated net to fold and unfold.

This invention of the autonomous two-sided opening system resolves the problem of getting wrong dimensions, as it is in the form of a kit. It also solves the above-mentioned technical problem where the width of the opening must necessarily be less than its height, as it does not use a rope end component. Thus, the movement of the pleats is unobstructed and consequently it does not require an opening only from one side, having the other side fixed on the frame.

In short, the invention has ropes which start above the net and on the same side, the side fixed at the retention case, and which run along the net parallel to each other, until the edge of the net, where there are metal trucks to fasten the ropes. Then the ropes pass through the trucks and are all directed to the upper fixed horizontal guide through a pulley located at the upper part of the sliding guide. This system uses only 2 pulleys at the upper part of the sliding guide—and fastened to the top part of the vertical fixed side guide (top end). At the same time, a wire rope has one end at the upper truck, passes horizontally over the net, then through a pulley at the upper part of the sliding guide, continues vertically to a second pulley at the bottom of the sliding guide, crosses the lower horizontal guide and is fastened to the lower part of the vertical fixed side guide (lower end). Thus, the wire rope, which is guided to the lower horizontal guide through the sliding guide, it is exactly the opposite direction and its way from the ropes, which are also directed towards the upper horizontal guide through the sliding guide. All the ropes are fastened to the upper part of the system, whereas all the wire ropes have one end fastened to the top part of the system and the other end to the lower part of the system. This contrasting tension on the system brings the maximum stability.

In case that a two-leaf frame is to be fixed to the opening, and in each case where more than two leaves are to be used, the system does not use a vertical fixed side guide, as one leaf stops opposite to the other. In this case, as end points of the ropes and the wire rope a run component and tension adjusters are used at the upper guide and a central end component is used at the lower guide.

A very important advantage of this invention is that thanks to the kit function, it solves the technical problem that arises when the anti-mosquito system comes from the factory in the wrong dimensions, higher than the opening where the system will be placed, a very often problem.

Thus, the production plant can produce ready-made prefabricated kit systems in specific heights of the two cases and the side guide, e.g. "kit with case and driver height from 1900 to 2200 mm", "kit with height from 2201 to 2500 mm" and "kit with height from 2501 to 2800 mm".

As a result, installation is easy and quick, as time is saved with the purchase of an autonomous kit. Also, the installation of the kit itself on the spot is extremely fast and simple as it requires only cutting the system to the correct length and screwing the detachable caps. This makes the system extremely user-friendly. Moreover, this invention uses self-detachable end components that are screwed into the system upon installation.

Thus, an additional advantage is the drastic reduction of production costs, which in turn helps the consumers to save money.

Another advantage of this invention is the single wire rope which gives stability throughout the system.

A further advantage is that this invention presents autonomous systems having leaves that each one open from both sides. Thus, many autonomous leaves with such opening can be placed in series, offering great stability. This solves the technical problem of covering openings with a width larger than the height of the opening, as there is no limitation on the movement of each leaf and the total number of leaves.

BRIEF DESCRIPTION OF THE SEVERAL VIEWS OF THE DRAWING(S)

The 14 drawing sheets accompanying the invention, illustrate, in short, the following:

FIG. 1 illustrates the autonomous anti-mosquito system with a one-side opening, at which all ropes end and are fastened at the upper part of the vertical fixed side guide, whereas the wire rope ends and is fastened at the lower part of the same guide. The net is completely unfolded.

Figure 2:
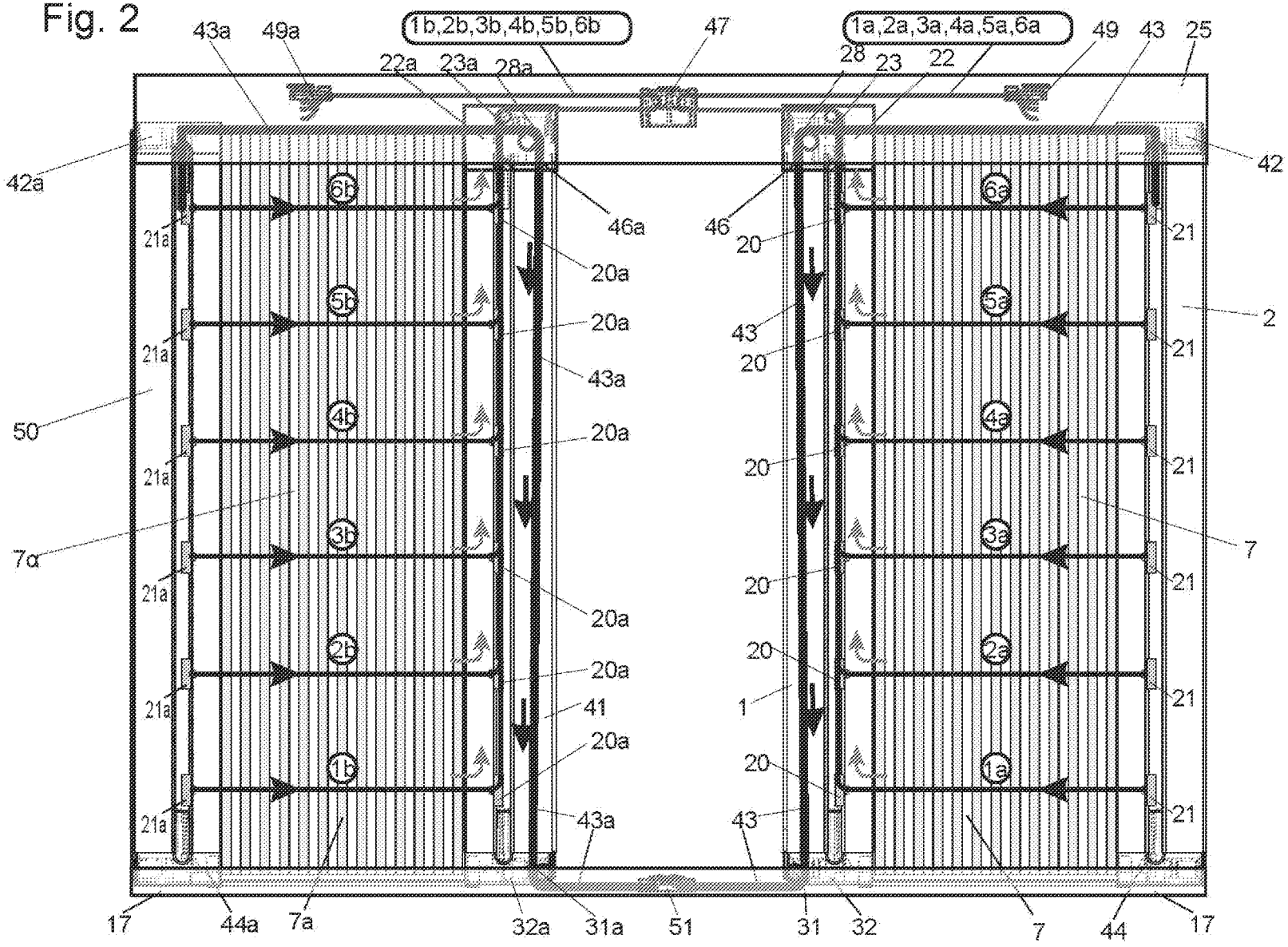

FIG. 2 illustrates the autonomous anti-mosquito system, with the one-sided opening of FIG. 1, as a double-leaved system closing centrally. The two systems are placed in the same frame opposite to each other with two sliding cases for the central closing/opening. The net of both leaves is unfolded by half. In the center of the opening, above and down, there are ropes run/end components, screwed onto the upper and lower horizontal guide.

Figure 3:
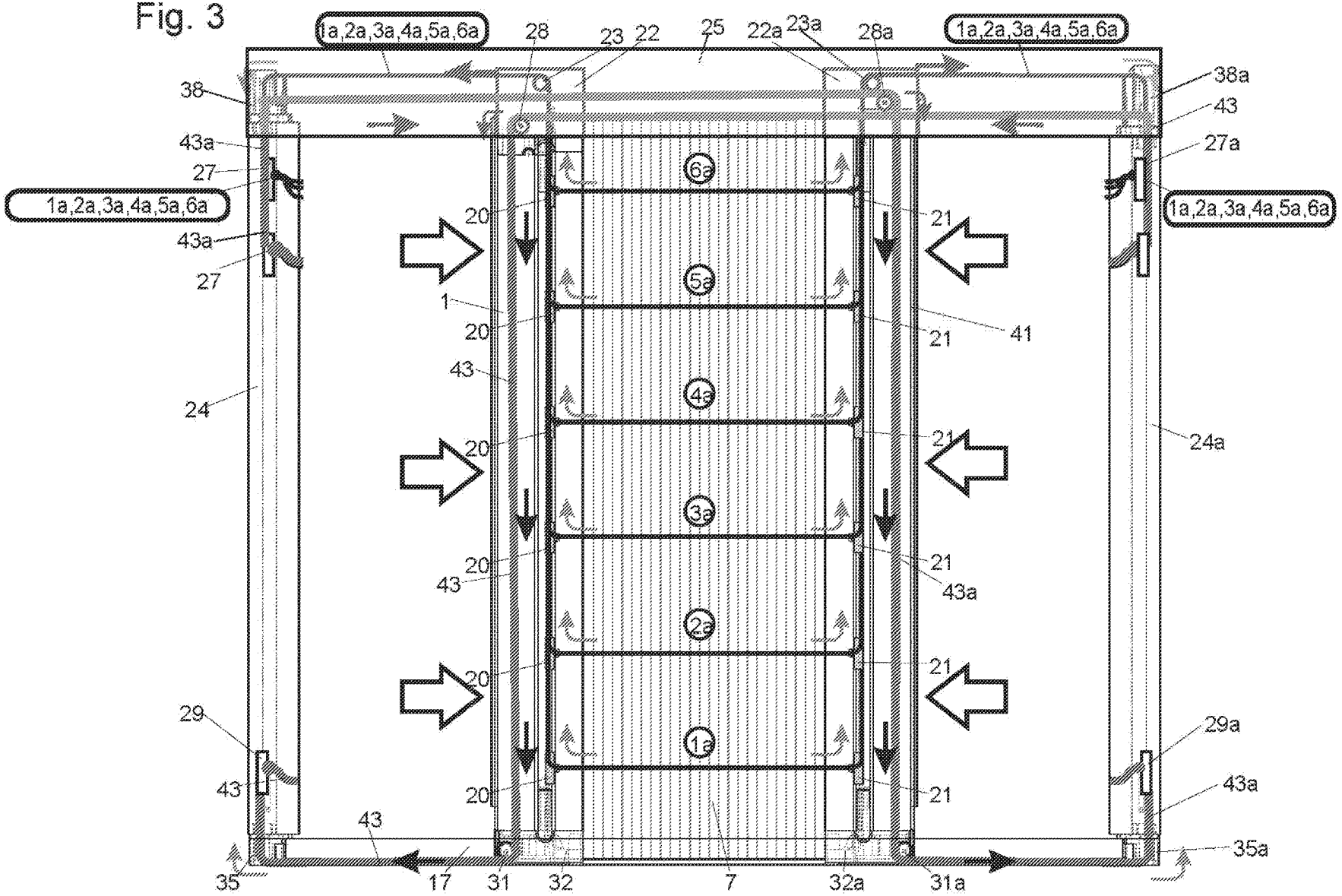

FIG. 3 illustrates a combination of FIGS. 1 and 2, the autonomous anti-mosquito system as a one-leaf system opening from both sides, two fixed side guides and two sliding cases. The net is unfolded by half on both sides.

Figure 4:
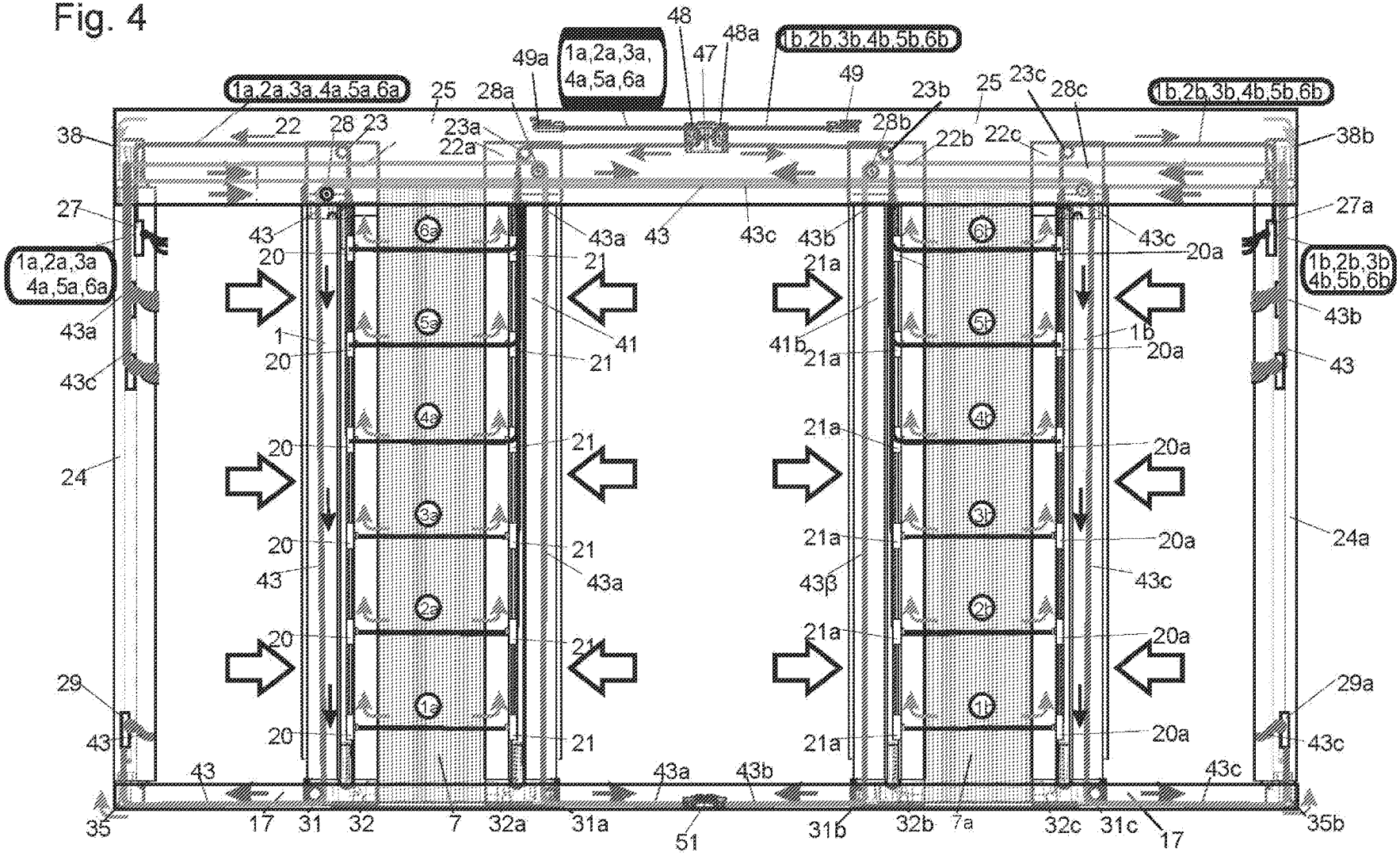

FIG. 4 illustrates a combination of FIGS. 1, 2 and 3, the autonomous anti-mosquito system, a double-leaved central system opening from both sides, two fixed side guides and four sliding cases. The net is unfolded by half at both leaves and both sides. In the center of the opening, above and down, there are run/end components, screwed onto the upper and lower horizontal guide.

Figure 5:
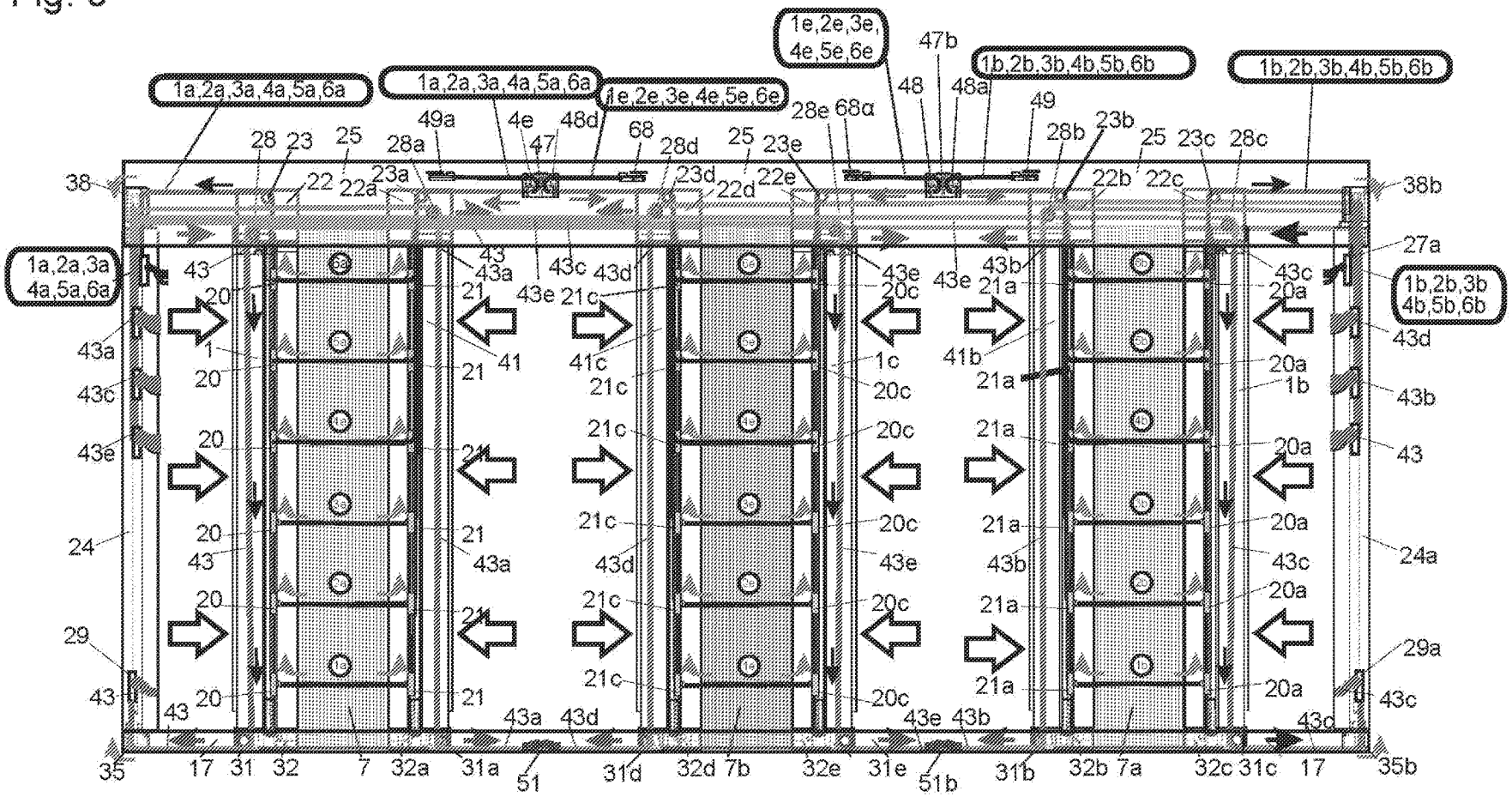

FIG. 5 illustrates the system of FIG. 4, as a three-leaved central system opening from both sides, two fixed side guides and six sliding cases. The net is unfolded by half at three leaves and both sides. At the spots where the sliding cases meet, there are run/end components, screwed onto the upper and lower horizontal guide.

FIGS. 6*a*, 6*b*, 7*a*, 7*b*, 7*c*, 7*d*, 8*a*, 8*b*, 9*a*, 9*b*, 9*c*, 9*d*, 10*a*, 10*b*, 10*c*, and 10*d* illustrate the run and end components of the ropes of the upper guide, that is, a central run component and two tension adjusters, which are screwed onto the upper horizontal guide.

Figure 6B:
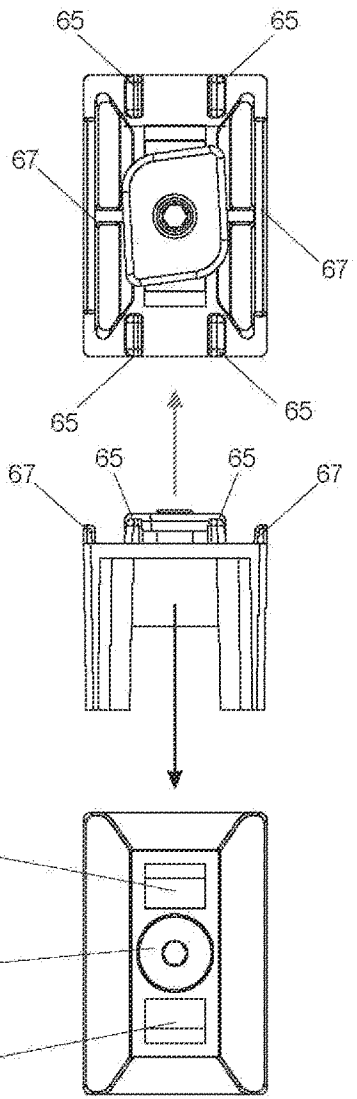

The perspective view of FIG. 6*b* illustrates the central run component, in upper, lateral and lower side of profile.

FIG. 7*a*, 7*b*, 7*c*, and 7*d* illustrate the four stages of screwing and fastening the central run component at the upper horizontal guide and the section of the profile of the upper horizontal guide in which the component is fixed.

The perspective view of FIG. 8 illustrates the tension adjuster for the ropes in upper, lateral and lower side of profile.

FIGS. 9*a*, 9*b*, 9*c*, and 9*d*illustrate the four stages of screwing and fastening the tension adjuster at the upper horizontal guide and the section of the profile of the upper horizontal guide in which the adjuster is fixed.

Figures 10A, 10B, 10C, 10D:
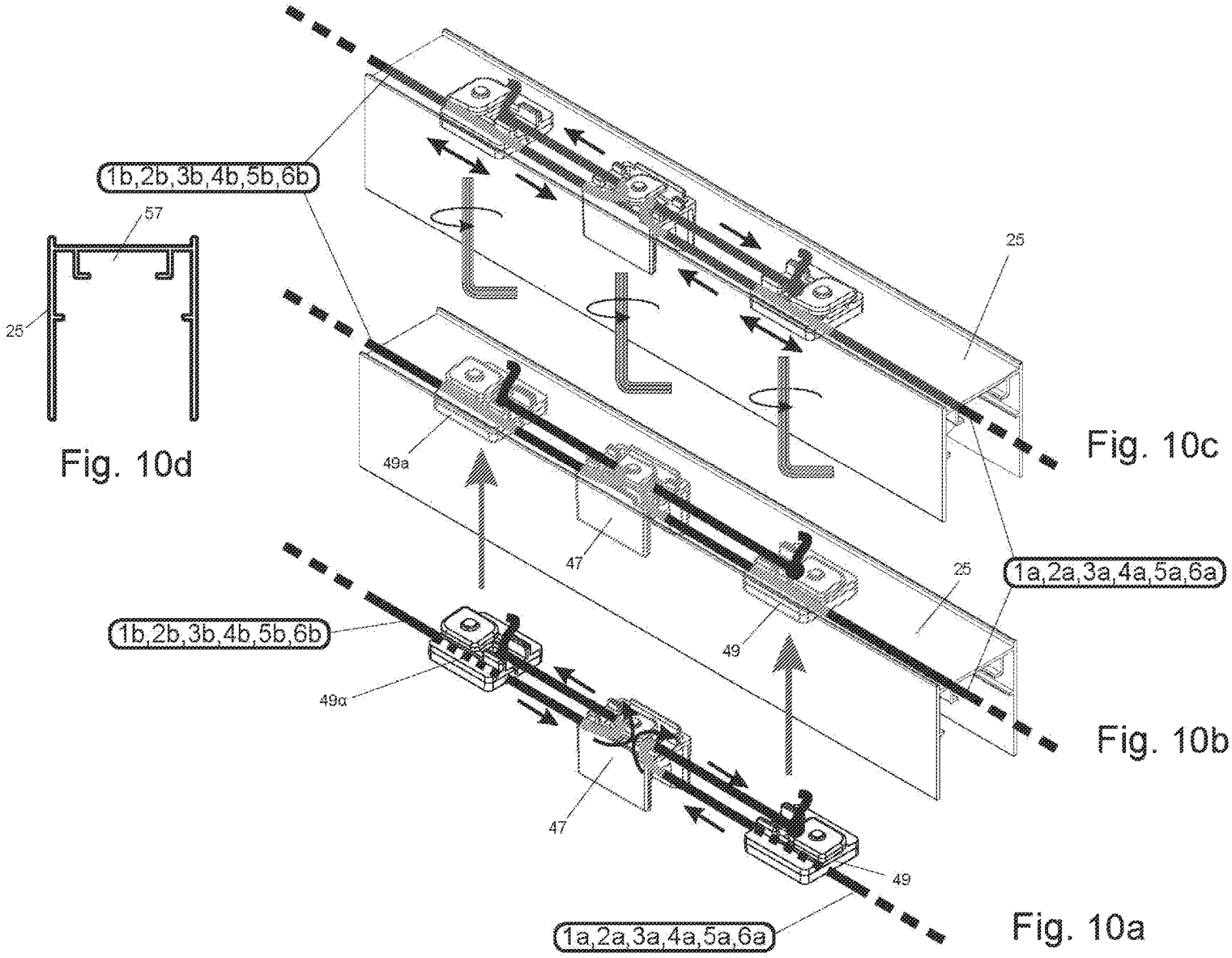

FIGS. 10*a*, 10*b*, and 10*c*illustrate the central run component and two tension adjusters, the mode of run and fastening of ropes and the installation and fastening of the components in the upper horizontal guide, in three stages.

FIGS. 11*a*, 11*b*, 12*a*, 12*b*, 13*a*, 13*b*, and 13*c* illustrate the lower ropes end component screwed in the center of the lower horizontal guide.

Figure 11B:
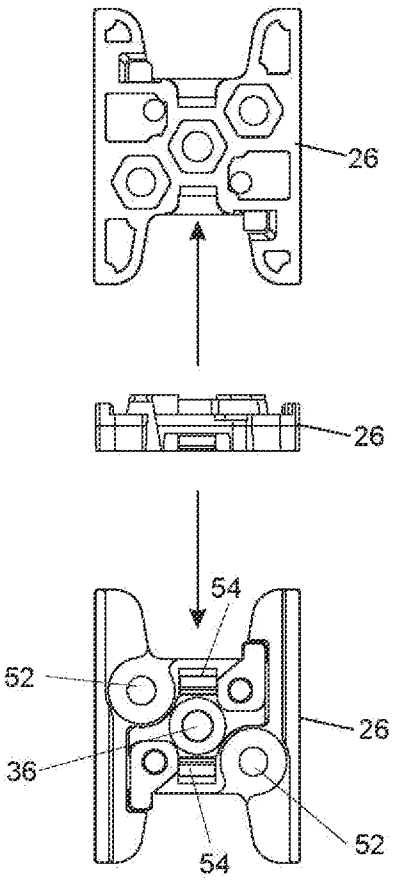
Figure 11A:
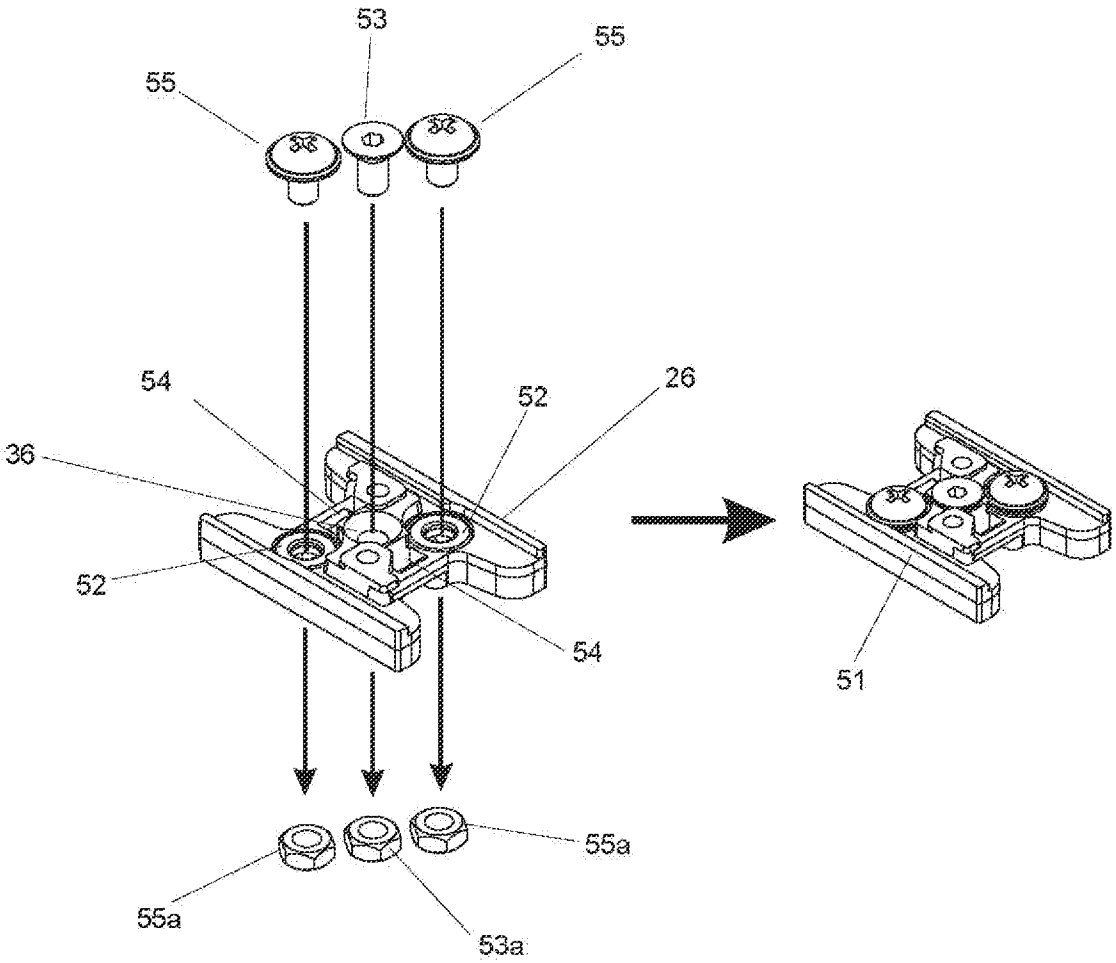

FIGS. 11*a* and 11*b* illustrate the lower component and the screws of the ropes end component the upper, lateral and lower side of the perspective profile.

Figure 12B:
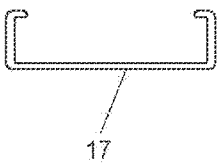
Figure 12A:
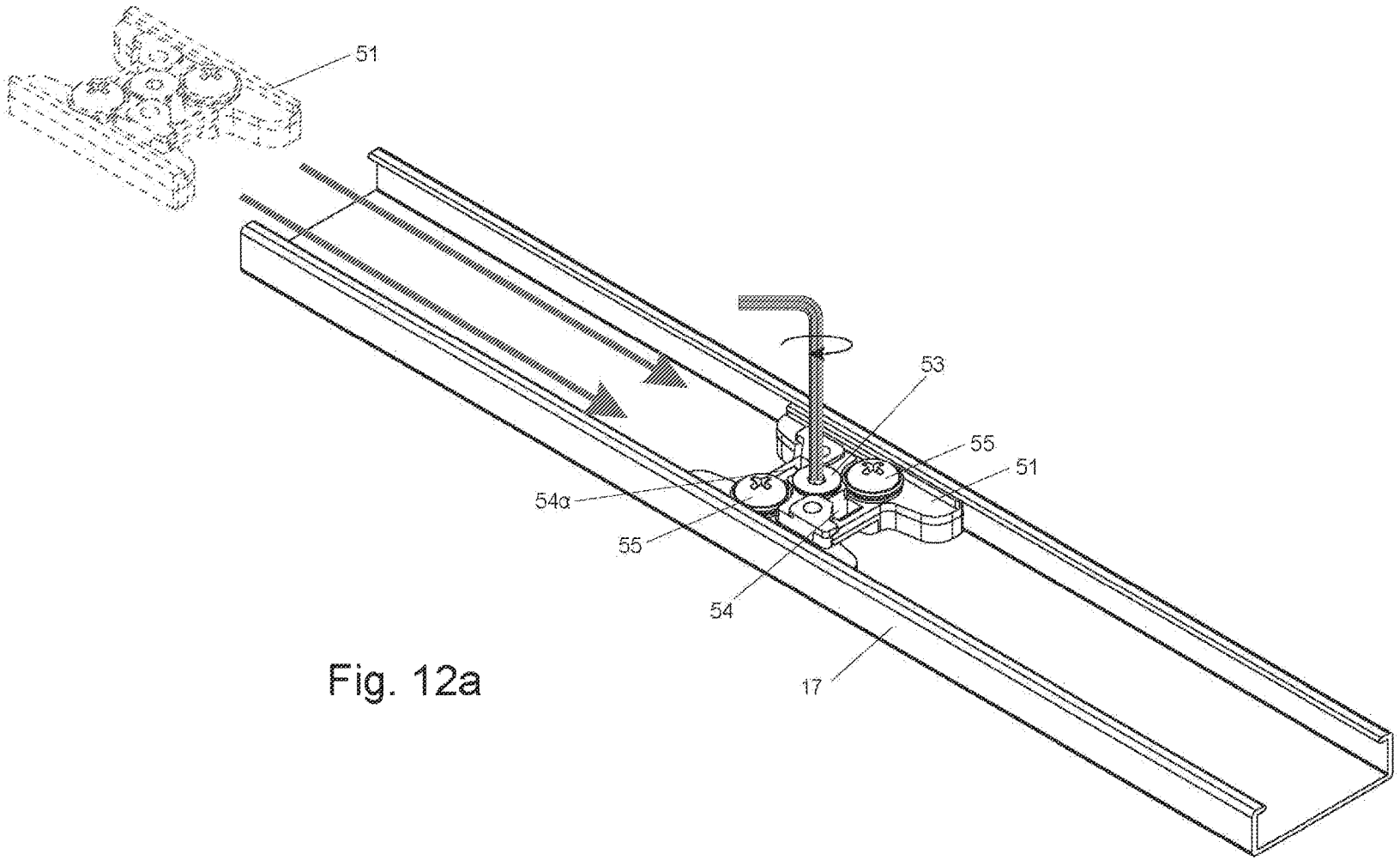

FIGS. 12*a* and 12*c* illustrate the mode by which the lower end component enters and is fastened in the lower horizontal guide.

Figure 13B:
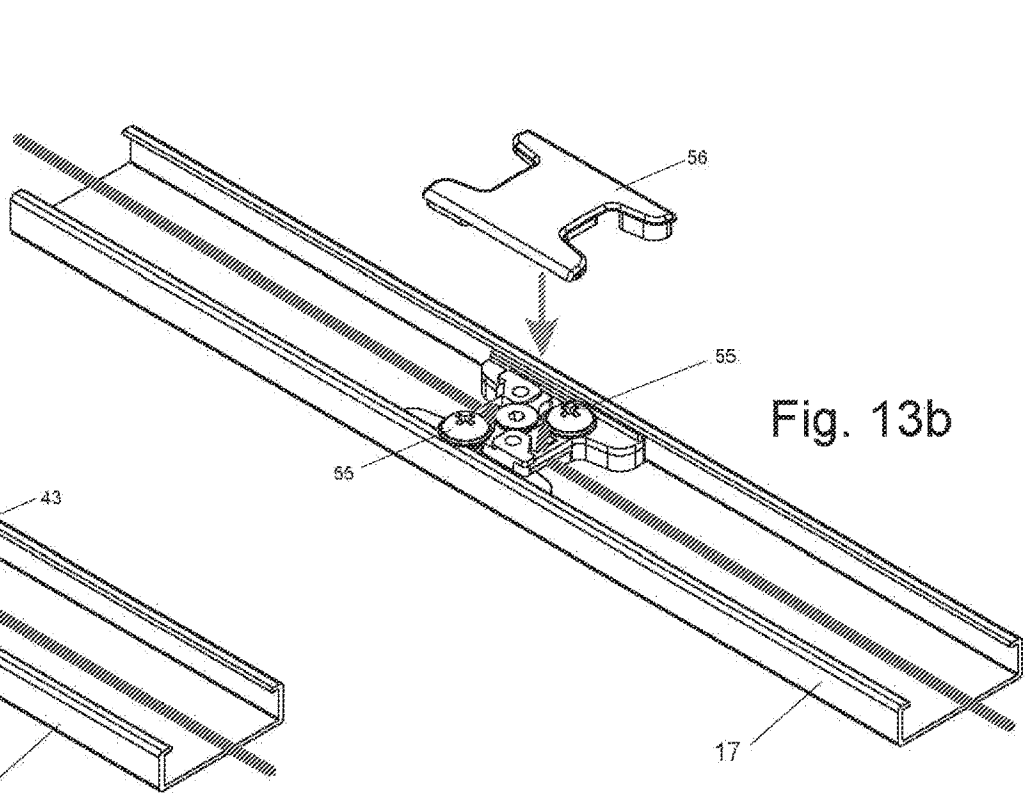
Figure 13C:
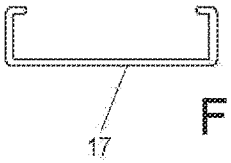
Figure 13A:
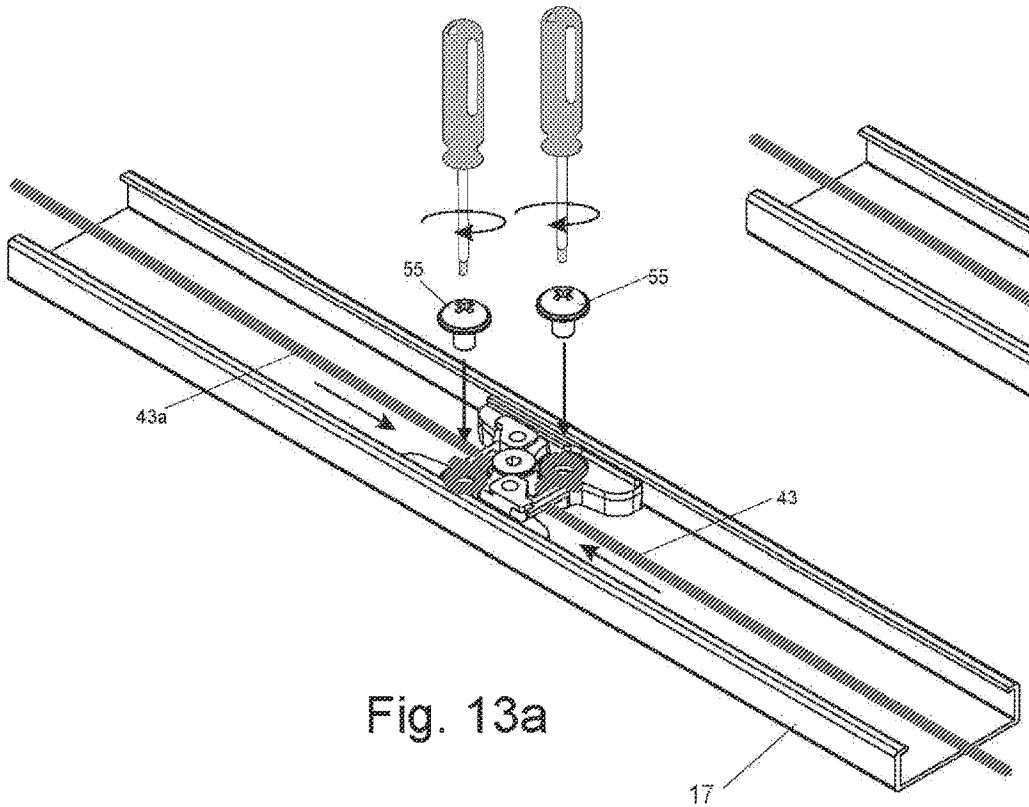

FIGS. 13*a*, 13*b*, and 13*c* illustrate the mode by which the wire ropes are stretched and fastened on the lower end component in the lower horizontal guide, as well as the cap placement on it.

Figure 14B:
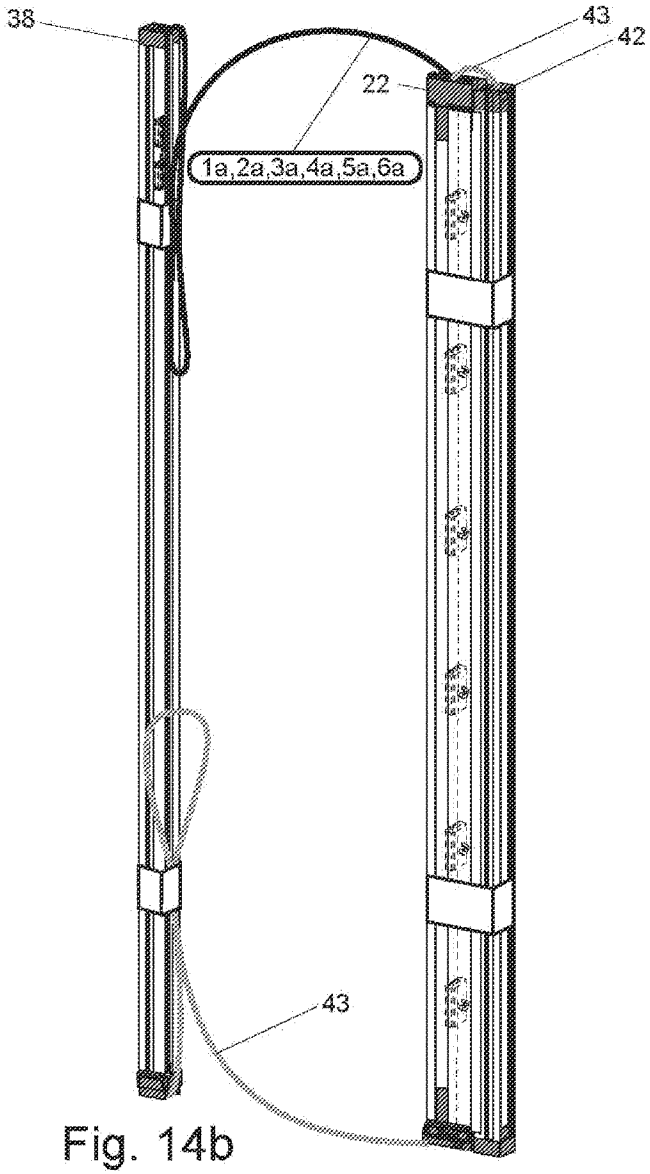
Figure 14A:
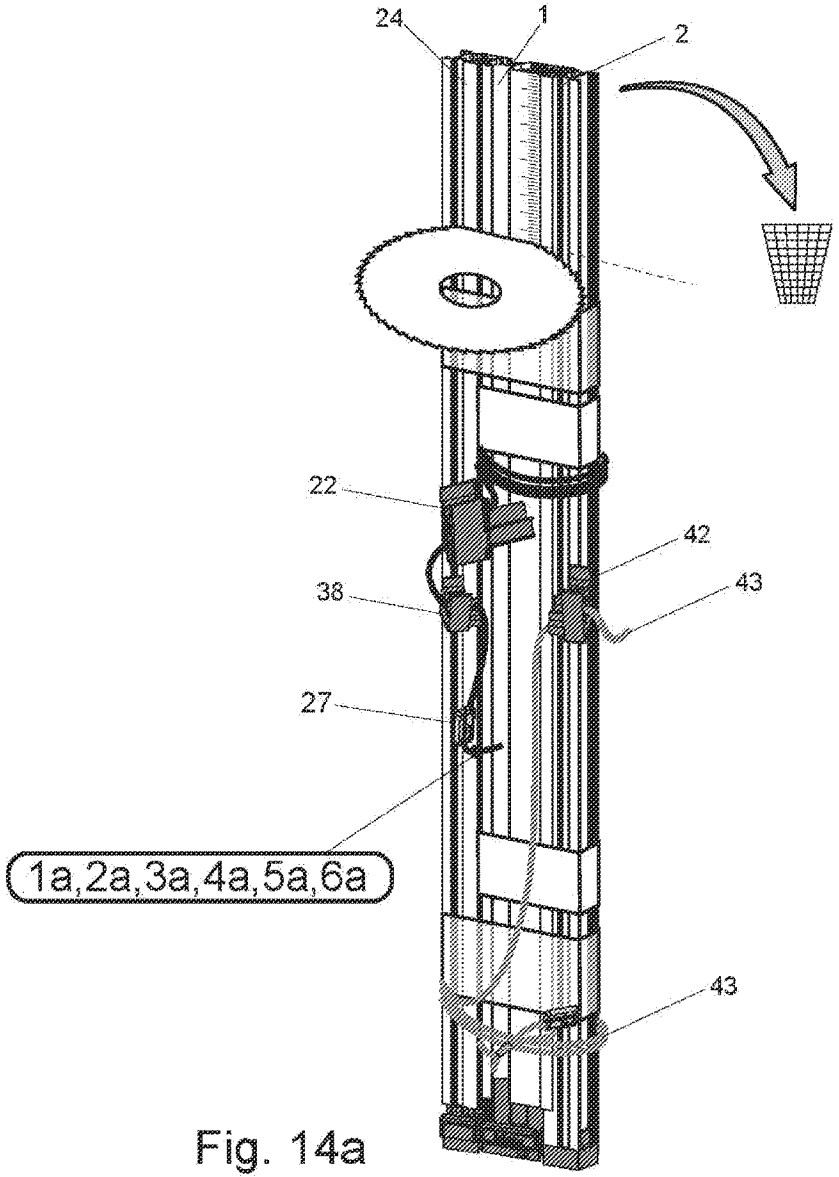

FIGS. 14*a* and 14*b* illustrate the autonomous anti-mosquito system with the one-sided opening of FIG. 1, semi-assembled in a kit (FIG. 14*a*) and the mode of assembling (FIG. 14*b*).

The description attached to the various figures herein refers to one example of the implementation of this invention, using a set with 6 ropes. However, this same invention may be implemented exactly in the same way by using a set with 3 to 8 ropes, depending on the height of the net.

DETAILED DESCRIPTION OF THE INVENTION

An example of application of this invention follows with a detailed description and reference to the attached drawings.

As FIG. 1 illustrates, the autonomous anti-mosquito system has on the left and on the right two cases, the sliding case (1) and the retention case (2), in a vertical position, parallel to each other.

At the initial position, the net is folded and the sliding case (1) is next to the retention case (2). When the sliding case (1) begins moving towards the side fixed guide (24) the pleated net (7) unfolds and the opening closes, whereas when it moves to the opposite direction towards the retention guide (2), the pleated net (7) folds and the opening opens.

The net (7) is run horizontally by six retention ropes (1*a*, 2*a*, 3*a*, 4*a*, 5*a*, 6*a*) all placed in a horizontal position and equally spaced apart from one another. All the ropes have trucks (21) as common starting points, which are located at that side of the net (7) which are found within the retention case (2). The ropes run across the net (7) horizontally, they reach the trucks (20) at the opposite side of the net (7) which are found within the sliding case (1), they run through the trucks (20) and are all directed upwards, to a detachable top edge (22) of the sliding case (1) within which there are two pulleys, the first (23) above the second (28) or vice-versa. The second pulley is mounted in block 46.

The six retention ropes (1*a*, 2*a*, 3*a*, 4*a*, 5*a*, 6*a*) as a bundle run around the above pulley (23), then cross horizontally the upper fixed horizontal guide (25) towards the vertical fixed side guide (24), which has a detachable top edge (38) with an opening. The six retention ropes (1*a*, 2*a*, 3*a*, 4*a*, 5*a*, 6*a*) pass through the opening of the upper detachable edge (38) of the vertical fixed side guide (24), continue downwards as a bundle and are fixed on an adjuster (27) at the upper part of the vertical fixed side guide (24).

At the first of the upper trucks (21) where the top rope (6*a*) is fastened, one edge of the wire rope (43) is fastened to the same truck. The upwardly extending wire rope passes through an opening of the upper part of the detachable upper end (42) of the retention guide (2), the opening being at a height above the height of the net (7) and then crosses the upper fixed horizontal guide (25) in a position horizontally over the net, having the same direction with the unfolding direction of the net, then passes through the second pulley (28) inside the removable upper end (22) of the sliding case (1) at a height above the height of the net (7) without touching it, continues vertically towards the lower fixed horizontal guide (17), passes around the pulley (31) in the detachable lower edge (32) of the sliding case (1); then it is directed through the horizontal guide (17) towards the detachable lower end (35) with the opening of the fixed vertical side guide (24), passes through the opening of the end (35), continues upwards and is fixed to an adjuster (29) in the lower part of the vertical fixed side guide (24). Thus, the wire rope (43) starts with one edge at the upper truck (21) in the retention guide (2) and ends with the other edge at the lower part of the vertical fixed side guide (24). The system is ready to be used.

Alternatively, the wire rope may have one edge fastened to the upper detachable edge (42) of the retention guide (2), runs horizontally the upper fixed horizontal guide and continues in exactly the same way, as described in detail in the previous paragraph.

FIG. 2 illustrates the application of the autonomous anti-mosquito system with the one-sided operating of FIG. 1, on a double leaved system with central closing. In this application both systems are fixed on the same frame, opposite to each other and move, with their moving side, towards each other. Each system has a retention case (2, 50) by which it is fastened on the frame and one sliding case (1, 41) the moves and folds/unfolds the net. The retention case (50) has a detachable lower end (44*a*). The leaves move towards each other, the anti-mosquito nets (7, 7*a*) are unfolded; the two sliding cases (1, 41) meet at the center of the opening and the double leaved central system closes. The function of the double leaved central system is the same with that of the one-sided opening system described above and illustrated in FIG. 1, incorporating the same invention idea, changing only the component in which the ropes and the wire rope end, as the two-leaf central system does not have a vertical side guide at which the ropes and the wire rope stop, therefore they stop when the two sliding cases (1, 41) meet at the center of the opening. Thus, the nets (7, 7 *a*) again each one are run horizontally by six retention ropes (1*a*, 2*a*, 3*a*, 4*a*, 5*a*, 6*a* and 1*b*, 2*b*, 3*b*, 4*b*, 5*b*, 6*b*) all placed horizontally and in equally spaced one from another, with common starting point the trucks (21, 21*a*) at the side of the net (7, 7*a*) which is fixed in the retention case (2, 50). The ropes run along the nets (7, 7*a*) horizontally and parallel to each other, end to trucks (20, 20*a*) to the opposite side of the net (7, 7*a*), which is fasted in the sliding case (1, 41), pass through the trucks (20, 20*a*) and are directed all together as a bundle upwards, to the detachable upper edge (22, 22*a*) of the sliding case (1, 41) in which there are two pulleys, the first (23, 23*a*) above the second (28, 28*a*). The second pulley (28*a*) is mounted in block (46*a*).

The two rope bundles (1*a*, 2*a*, 3*a*, 4*a*, 5*a*, 6*a* and 1*b*, 2*b*, 3*b*, 4*b*, 5*b*, 6*b*) run around the upper (23, 23*a*) pulley of each leaf, cross horizontally the upper fixed horizontal guide (25) and reach the center of the opening at a ropes' central run component (47), exactly as the one-side opening described above and illustrated in FIG. 1. The ropes' central run component (47) is fastened on the upper fixed horizontal guide (25) inside a socket (57) (drawings 6, 8, and 10). The run component (47) (FIGS. 6*a* and 6*b*) has two through openings (48, 48*a*). The ropes (1*a*, 2*a*, 3*a*, 4*a*, 5*a*, 6*a*) of the first leaf come from the one side of the run component (47) and as a bundle pass through the opening (48), from downwards to upwards (FIG. 10*a*), invert their movement and continue, inside the upper fixed guide (25) towards the retention case (2) from where they started and end to the tension adjuster (49) (FIGS. 8*a* and 8*b*), also fixed on the upper fixed horizontal guide (25), inside the socket (57) in the same line with the ropes' central run component (47). In the exactly same way, the ropes (1*a*, 2*a*, 3*a*, 4*a*, 5*a*, 6*a*) of the second leaf come from the other side of the run component (47) and pass as a bundle from the other opening (48*a*), from downwards to upwards, invert their movement and continue inside the upper fixed guide (25) towards the retention case (50) from where they stared and end at the tension adjuster (49*a*) also fastened on the upper fixed horizontal guide (25) inside the socket (57) in the same line with the ropes' central run component (47).

At the same time, the edge of each wire rope (43, 43*a*) is fastened at the two first upper trucks (21, 21*a*), where the upper ropes are fastened (6*a*, 6*b*) (FIG. 2). The wire rope (43) begins from the truck (21) of the first net (7) upwards, passes through the opening of the upper part of the detachable upper end (42) of the retention guide (2), the opening is above the net (7), then it crosses the upper fixed horizontal guide (25) horizontally above the net (7) without touching it, having the same direction with that of the net unfolding, it passes through the second pulley (28) inside the detachable upper edge (22) of the sliding case (1) and above the net (7), continues vertically towards the lower fixed horizontal guide (17), goes around the pulley (31) inside the detachable lower edge (32) of the sliding case (1). Then, it continues through the lower fixed horizontal guide (17) towards its center and are fixed on a ropes' central end component (51) screwed in the middle of the lower fixed horizontal guide (17) (FIGS. 11*a*, 11*b*, 12*a* and 12*b*). The retention case (2) has a detachable lower end (44). Similarly, the wire rope (43*a*) of the other leaf starts from the truck (21*a*) of the second net (7*a*) upwards, passes from the opening of the upper part of the detachable upper part (42*a*) of the retention guide (50), the opening is above the net (7*a*), crosses the upper fixed horizontal guide (25) horizontally above the net (7*a*) without touching it, having the same direction with that of the net folding, then passes through the second pulley (28*a*) inside the detachable upper edge (22*a*) of the sliding case (41) and above the net (7*a*), continues vertically towards the lower fixed horizontal guide (17), passes around the pulley (31*a*) inside the detachable lower edge (32*a*) of the sliding case (41). Then through the lower fixed horizontal guide (17) it continues to its center and is also fastened at the ropes' central end component (51).

As illustrated in FIGS. 11*a*, 11*b*, 12*a*, 12*b*, 13*a*, 13*b*, and 13*c*, the lower end component (51) consists of a plastic H-shaped component (26) and a plastic protective cap (56). The H-shaped plastic component (26) has a central fastening hole (36), two tension holes (52) of the wire ropes and two holes (54) through which the wire ropes pass. The plastic component (26) is pulled inside the socket of the lower horizontal guide (17) and is fastened in the center of the guide (17) with a screw (53) and a nut (53 *a*) from the central fastening hole (36). The two wire ropes (43, 43*a*) enter upwards from both holes (54) and are fastened with screws (55) and nuts (55*a*) at the two tension holes (52). The ropes' lower end component (51) has rails for the sliding cases that enter and are fastened inside it.

The system is ready to be used.

As illustrated in FIG. 3, the system can function in exactly the same way as a one-leave system with a two-sided opening, without requiring a retention guide, with only two fixed side guides (24, 24*a*) and two sliding cases (1, 41). In this type of the system, a set of ropes (1*a*, 2*a*, 3*a*, 4*a*, 5*a*, 6*a*) and two wire ropes (43, 43*a*) are used. In particular, all the ropes (29*a*, 2*a*, 3*a*, 4*a*, 5*a*, 6*a*) have a common starting point for the adjustor (27*a*) at the upper part of the vertical fixed side guide (24*a*). They pass through the opening of the upper detachable end (38*a*) of the vertical fixed side guide (24*a*), then as a bundle they continue round the upper pulley (23*a*) inside the upper detachable end (22*a*) of the sliding guide (41), go down in the sliding guide (41) and each passes through the truck (21) of the net (7). Then, just as in the system described above with reference to FIG. 1, the ropes run the net (7) horizontally in a position parallel to each other, ending on the opposite side of the net (7) into trucks (20) fixed inside the sliding case (1), they pass through the trucks (20) and directed upwards toward the removable upper end (22) of the sliding case (1) in which there are two pulleys, the first (23) above the second (28). The six retention ropes (1*a*, 2*a*, 3*a*, 4*a*, 5*a*, 6*a*) pass around the upper pulley (23), run horizontally the upper fixed horizontal guide (25), toward the vertical fixed side (24), pass through the opening of the upper detachable end (38) of the vertical fixed side guide (24), go downwards and are fastened to an adjuster (27) inside the upper part of the vertical fixed side guide (24).

Two wire ropes are used at the one-leaf system with two-sided opening. The two wire ropes (43, 43*a*) are fitted opposite, that is, one (43) starts from the upper part of the right fixed side guide (24*a*) and ends at the lower part (29) of the left fixed side guide (24) and the other one (43*a*) just opposite, that is, it starts from the upper part of the left fixed side guide (24) and ends at the lower part (29*a*) of the right fixed side guide (24*a*), whereas both pass above the net. More specifically, one wire rope (43) is fastened with one edge at the upper part of the right vertical fixed side guide (24*a*). The wire rope passes upwards through the opening of the side guide (24*a*), which is above the net (7), and then with exactly the same way as in the system described above with reference to FIG. 1, is crosses the upper fixed horizontal guide (25) horizontally, always above the net (7) without coming into contact with it, with a direction the same with that of the direction of unfolding the net, it passes the net (7), then passes through the second pulley (28) inside the detachable upper edge (22) of the left sliding case (1), continues downwards to the lower fixed horizontal guide (17), continues around the pulley (31) inside the detachable lower end (32) of the sliding case (1). Then it continues through the horizontal guide (17) towards the detachable lower edge (35) with an opening, of the fixed vertical side guide (24), passes through the opening of the lower edge (35) and goes upwards and is fastened at an adjuster (29) at the lower part of the left vertical fixed side guide (24).

The second wire rope (43*a*) follows a reverse course, is fastened with one edge at the upper part of the left vertical fixed side guide (24). The wire rope passes upwards through the opening of the side guide (24) which is above the net (7), and then in exactly the same way, as the system described above with reference to FIG. 1, follows the reverse course of the first wire rope (43), that is, crosses the upper fixed horizontal guide (25) horizontally always above the height of the net without coming into contact with it, having the same direction with that of the unfolding of the net, passes by the net (7), then passes through the second pulley (28 *a*) inside the detachable upper edge (22*a*) of the right sliding case (41), continues vertically downwards to the fixed horizontal guide (17), continues round the pulley (31*a*) inside the detachable lower part (32*a*) of the right sliding case (41). Then it continues through the horizontal guide (17) to the detachable lower edge (35*a*) with opening of the fixed right side guide (24*a*), passes from the opening of the lower edge (35*a*) and goes upwards and is fastened at an adjuster (29*a*) at the lower part of the right vertical fixed side guide (24*a*).

The system is ready to be used.

As illustrated in FIG. 4, the system may operate with exactly the same way, as a two-leaved system with openings on both sides, without retention guides (2, 50), only with two fixed side guides (24, 24*a*) and four sliding cases (1, 41 and 1-*b*, 41*b*) two for each leaf. In this type of the system, two rope sets are used (1*a*, 2*a*, 3*a*, 4*a*, 5*a*, 6*a* and 1*b*, 2*b*, 3*b*, 4*b*, 5*b*, 6*b*) and four wire ropes (43, 43*a*, 43*b*, 43*c*), of which two (43*a* and 43*c*) begin from the upper part of the left side guide (24) and one (43*a*) passes above the left leaf (7) and is fastened at the lower guide (17), whereas the other one (43*c*) passes above both leaves (7, 7*a*) and is fastened at the left side guide (24). Similarly, the other two wire ropes (43, 43*b*) begin from the upper part of the right side guide (24*a*), one of which (43*b*) passes above the right leaf (7*a*) and is fastened at the lower guide (17), whereas the other (43) passes above both leaves (7*a*, 7) and is fastened at the right side guide (24*a*). At the center of the opening, there are run/end components for the ropes—upper (47, 49, 49*a*) and lower (51) screwed at the upper (25) and lower (17) horizontal guide. At this two-leaved system with openings from both sides, each leaf functions independently within the system.

More particularly, exactly as in the system described above with reference to FIG. 3 of the one-leaf system with opening on both sides, at this two-leafed system all ropes (1*a*, 2*a*, 3*a*, 4*a*, 5*a*, 6*a*) of the leaf (7) have a common starting point for the adjuster (27) at the upper part of the vertical fixed side guide (24). They pass through the opening of the upper detachable edge (38) of the vertical fixed side guide (24), pass horizontally as a bundle through the upper pulley (23) inside the upper detachable edge (22) of the sliding case (1), move downwards into the sliding case (1) and each goes to one truck (20) of the net (7) of the first leaf. There is a central closing, exactly in the way described above with reference to FIG. 2. That is, the ropes cross the net (7) horizontally and in a parallel to each other, end at the opposite side of the net (7) at trucks (21) fixed inside the opposite sliding case (41), pass through the trucks (21) and continue upwards to the detachable upper edge (22*a*) of the sliding case (41) within which there are two pulleys, the first (23*a*) above the second (28*a*). The six retention ropes (1*a*, 2*a*, 3*a*, 4*a*, 5*a*, 6*a*) pass around the pulley (23*a*), cross horizontally the upper fixed horizontal guide (25) towards the central closing and reach the center of the opening at a central component through which the ropes pass (47) (FIGS. 4, 6*a*, 6*b*, 10*a*, 10*b*, 10*c*, and 10*d*). The ropes (1*a*, 2*a*, 3*a*, 4*a*, 5*a*, 6*a*) of the first leaf reach from one side of the run component (47) and pass as a bundle through the opening (48) upwards, reverse their course continuing inside the upper fixed guide (25) directed towards the retention case (24) from where they started and end at a tension adjuster (49 *a*) fixed also on the upper fixed horizontal guide (25). The couples of pulleys of each leaf (couples 23, 23*a*) and through which the ropes pass, are at the same height; similarly, the other couple of pulleys (28, 28*a*) through which the wire rope passes.

As in the one-leaf system with opening from both sides described above with reference to FIG. 3, also at the two-leaf system (FIG. 4) one wire rope (43) is fastened at one end to the upper part of the right vertical side guide (24*a*), it starts at the upper part of the right fixed side guide (24*a*) and ends at the lower part (29) of the left fixed side guide (24). In particular, the rope passes upwards through an opening of the side guide (24*a*) which is above the height of the nets (7, 7*a*), and then in exactly the same way as in the system described above in detail with reference to FIGS. 1, 2 and 3, it crosses the upper fixed horizontal guide (25) horizontally, always above the height of the two nets (7, 7*a*) without coming into contact with them, it passes through the nets, then it passes through the second pulley (28) inside the detachable upper edge (22) of the left sliding case (1) of the second leaf (17), continues upwards to the lower fixed horizontal case (17), goes around the pulley (31) inside the detachable lower edge (32) of the sliding cases (1) of the second leaf (7), then it continues through the horizontal guide (17) to the detachable lower end (35) with an opening of the fixed vertical guide (24), passes through the opening of the lower edge (35), goes upwards and is fastened to an adjuster (29) at the lower part of the left vertical fixed side guide (24).

The second wire rope (43*a*) is placed exactly opposite, that is, it begins from the upper part of the left fixed side guide (24), encircles the first leaf (7) and ends and is fastened at the ropes' central end component (51) at the lower fixed guide (17). In particular, the wire rope (43*a*) is fastened with one end at the upper part of the left vertical fixed side guide (24). Going upwards, the wire rope passes through the opening of the side guide (24), which is above the net (7) and then, in the exactly same way as in the system described above with reference to FIG. 1, it crosses the upper fixed horizontal guide (25) horizontally, always above the net (7) without coming into contact with it, it passes by the net (7), then passes through the second pulley (28*a*) inside the detachable upper edge (22*a*) of the right sliding case (41), continues vertically to the lower fixed horizontal guide (17), goes around the pulley (31 *a*) inside the detachable lower edge (32*a*) of the right sliding case (41). Then it continues through the lower horizontal guide (17) to its center and is fastened at a ropes' central end component (51) that is screwed in the middle of the lower horizontal guide (17) (FIGS. 4, 11*a*, 11*b*, 12*a*, and 12*b*).

The second leaf (7 *a*) functions exactly in the same way, having all components opposite and symmetrical to the components of the first leaf. All ropes (1*b*, 2*b*, 3*b*, 4*b*, 5*b*, 6*b*) of the leaf (7*a*) have a common starting point for the adjuster (27*a*) at the upper part of the vertical fixed side guide (24*a*). They pass from the opening of the upper detachable edge (38*b*) of the vertical fixed side guide (24*a*), pass as a bundle from the upper pulley (23*c*) inside the upper detachable edge (22*c*) of the sliding guide (41*b*), continue vertically inside the sliding guide (1-*b*) and each goes to a truck (20*a*) of the net (7*a*) of the second leaf. Then, exactly as in the system of the first leaf, the ropes run the net (7*a*) horizontally and parallel to each other, end at the opposite side of the net (7*a*) at trucks (21*a*) fixed inside the sliding case (41*b*), pass through the trucks (21*a*) and go upwards to the detachable upper edge (22*b*) of the sliding case (41*b*) in which there are two pulleys, the first (23*b*) above the second (28*b*). The six retention ropes (1*b*, 2*b*, 3*b*, 4*b*, 5*b*, 6*b*) pass as a bundle around the upper (23*b*) pulley, cross horizontally the upper fixed horizontal guide (25) towards the central closing and reach the center of the opening at a central run component (47) (FIGS. 4, 6*a*, 6*b*, 10*a*, 10*b*, 10*c*, and 10*d*). The ropes (1*b*, 2*b*, 3*b*, 4*b*, 5*b*, 6*b*) of the second leaf that come from the opposite side of the run component (47) of the ropes (1*a*, 2*a*, 3*a*, 4*a*, 5*a*, 6*a*) of the first leaf and pass as a bundle the second opening (48*a*) upwards, reverse their course, continuing always inside the upper fixed guide (25) towards the retention case (24*a*) from where they started and end at a tension adjuster (49) that is also fixed on the upper fixed horizontal guide (25).

The third wire rope (43*c*) is placed in a similar way with the first wire rope (43) of the first leaf, exactly opposite and symmetrical thereto. In particular, it is fastened with one edge at the upper part of the left vertical fixed side guide (24). Continuing upwards, the wire rope (43*c*) passes from the opening of the side guide (24) which is above the nets (7, 7*a*) and then, in exactly the same way as the system of the first leaf, it crosses the upper fixed horizontal guide (25) horizontally, always above the two nets (7, 7*a*) without coming into contact with them, then passes through the second pulley (28*c*) inside the detachable upper edge (22*c*) of the right sliding guide (1-*b*) of the second leaf (7*a*), continues vertically to the lower fixed horizontal guide (17), goes around the pulley (31*c*) inside the detachable lower edge (32*c*) of the sliding case (1-*b*). Then it continues through the horizontal guide (17) towards the detachable lower edge (35*b*) with opening of the fixed vertical side guide (24*a*), passes through the opening of the lower edge (35*b*) and continues upwards and is fastened at an adjuster (29*a*) at the lower part of the right vertical fixed side guide (24*a*).

The fourth wire rope (43*b*) continues an opposite and symmetrical course to that of the wire rope (43*a*) described above encircling the first leaf (7). In particular, the fourth wire rope (43*b*) is fixed with one edge at the upper part of the right vertical fixed side guide (24*a*). Going upwards, the wire rope (43*b*) passes through the opening of the side guide (24*a*) which is above the height of the net (7*a*) and then, in exactly the same way as in the first leaf described above, it crosses the upper fixed horizontal guide (25) horizontally, always above the net (7*a*) without coming into contact with it, it passes by the net (7*a*), then passes through the second pulley (23*a*) inside the detachable upper edge (22*b*) of the left sliding case (41*b*), continues vertically to the lower fixed horizontal guide (17), goes around the pulley (31*b*) inside the detachable lower edge (32*b*) of the left sliding case (41*b*), continues through the horizontal guide (17) to its center and is fastened at a ropes' central end component (51) screwed in the middle of the lower fixed horizontal guide (17) (FIGS. 4, 11*a*, 11*b*, 12*a*, and 12*b*), exactly from the other side of the end component (51) where the opposite wire rope (43*a*) of the system ended.

The system is ready to be used.

Finally, as illustrated in FIG. 5, the system can function in exactly the same way as a three-leaf system with openings from both sides. In this type, the system functions as follows: the two side leaves function exactly in the same way that was described above with reference to FIG. 4. A third leaf (7*b*) is placed between them (FIG. 5), but with the mode described more independent leaves may be placed, making the system four-leaved, five-leaved, etc, thus allowing the closing of a wide opening. In particular, the in-between leaf (7*b*) has two sliding guides (43 *d*, 43 *e*) at both sides and has its own rope set (le, 2*e*, 3*e*, 4*e*, 5*e*, 6*e*). At both sides of the leaf, upper and lower, screwed at the upper (25) and lower (17) horizontal guide, there are run/end rope components (47, 47*b*), tightening pulleys (68, 68*a*) and lower end components (51, 51*b*) at the point where the sliding guides of the leaves end and meet.

The function of the in-between leaf (7*b*), as that of each additional in-between leaf, is as follows: All ropes (le, 2*e*, 3*e*, 4*e*, 5*e*, 6*e*) of the leaf (7*b*) run the net (7*b*) horizontally and parallel to each other, passing through the trucks (20*c* and 21*c*) that the net has at its edges. Then with both ends they continue as bundles upwards to the two detachable upper edges (22*d* and 22*e*) of the two sliding guides (43*d* and 43*e*). Inside each edge (22*d* and 22*e*) there are two pulleys (23*d*, 28*d* and 23*e*, 28*e*). They pass as bundles through both pulleys (23*d* and 23*e*), cross horizontally the upper fixed horizontal guide (25) towards each one the ropes' central run component (47 and 47*b*) being closer to it (FIGS. 5, 6*a*, 6*b*, 10*a*, 10*b*, 10*c*, and 10*d*). Each bundle passes through the openings (48*d* and 48) of each central component, upwards, reverse their course continuing always inside the upper fixed guide (25) with return direction towards the leaf (7*b*) and end at the tension adjusters (68, 68*a*) also fixed on the upper fixed horizontal guide (25).

The two wire ropes (43*d*, 43*e*) of the in-between leaf (7*b*) start each one from the vertical side guides (24*a*, 24) and end at the lower end component (51, 51*b*). In particular, the first wire rope (43*d*) is fixed with one edge at the upper part of the right vertical fixed side guide (24*a*). Going upwards, the wire rope passes through the opening of the side guide (24*a*) that is at a height above all nets, crosses the upper fixed horizontal guide (25) horizontally, always above the nets, passes by the net (7*b*) without coming into contact with it, then passes through the second pulley (28*d*) inside the detachable upper edge (22*d*) of the left sliding case (43*d*), continues vertically towards the lower fixed horizontal guide (17), passes round the pulley (31*d*) inside the detachable lower edge (32*d*) of the left sliding case (43*d*). Then, it continues through the horizontal guide (17) at the ropes' lower end component (51) that is screwed at the lower fixed horizontal guide (17) and is fastened there (FIGS. 5, 11*a*, 11*b*, 12*a*, 12*b*).

The second wire rope (43*e*) is fastened with one edge at the upper part of the left vertical fixed side guide (24). Going upwards, the wire rope passes through the opening of the side guide (24) which is at a height above all nets, crosses the upper fixed horizontal guide (25) horizontally, always above the height of the nets, passes by the net (7*b*) without coming into contact with it, then passes through the second pulley (28*e*) inside the detachable upper edge (22*e*) of the right sliding case (43*e*), continues vertically towards the lower fixed horizontal guide (17), passes around the pulley (31*e*) inside the detachable lower edge (32*e*) of the right sliding case (43*e*). Then, it continues through the horizontal guide (17) to the ropes' lower central end component (51*b*) that is screwed at the lower fixed horizontal guide (17), where it is fastened (FIGS. 4, 11*a*, 11*b*, 12*a*, and 12*b*).

Figure 6A:
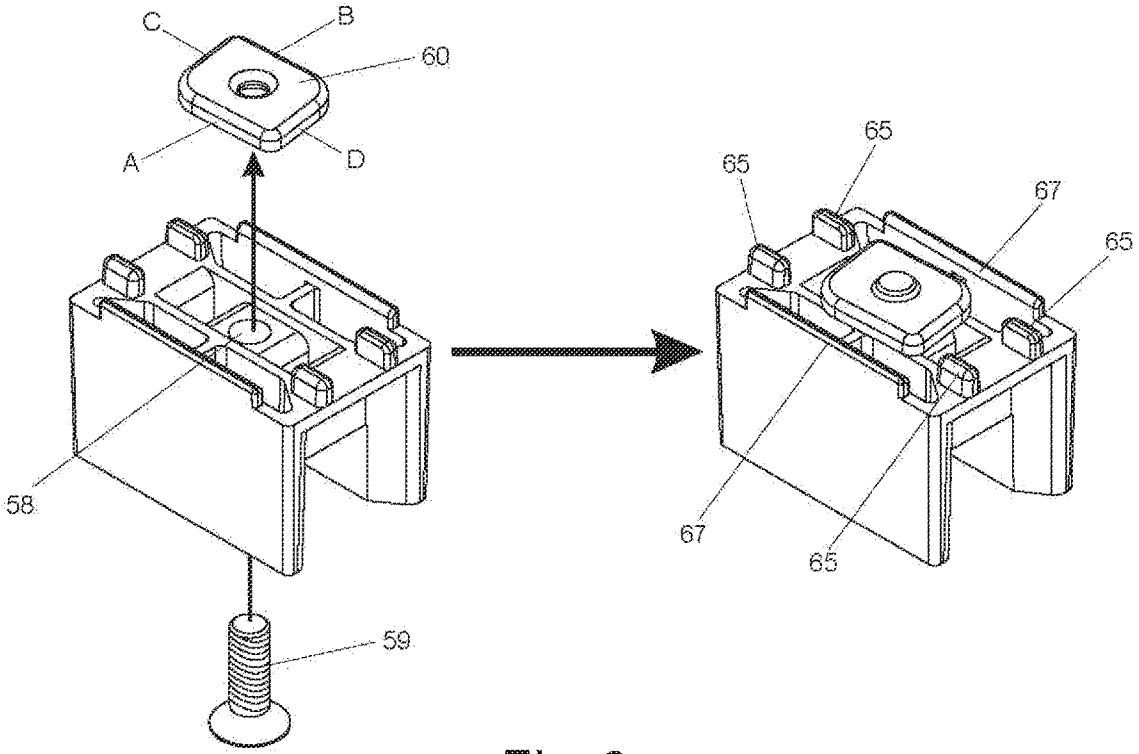

FIGS. 6*a*, 6*b*, 7*a*, 7*b*, 7*c*, 7*d*, 8*a*, 8*b*, 9*a*, 9*b*, 9*c*, 9*d*, 10*a*, 10*b*, 10*c*, and 10*d* illustrate the mode by which the central ropes' run component (47) and the two tension adjusters (49) are fastened inside the upper fixed guide (25). The ropes' central run component (47) (FIGS. 6*a*, 6*b*, 7*a*, 7*b*, 7*c*, 7*d*) has two through square openings (48, 48*a*) and in the middle a through hole (58), through which a screw (59) passes from the lower part of the component and on which a rhomboid butterfly (60) is screwed. The butterfly nut (60) has two sides (A, B) larger than the other two (C, D), where the two smaller sides (C, D) have a smaller width than the width of the receptor (57) that the upper fixed guide (25) has, inside which the run component (47) will be stabilized. The component also has on its upper surface four mountings (65) and two parallel mountings (67) along its edges (FIGS. 6*a* and 6*b*).

Figure 8B:
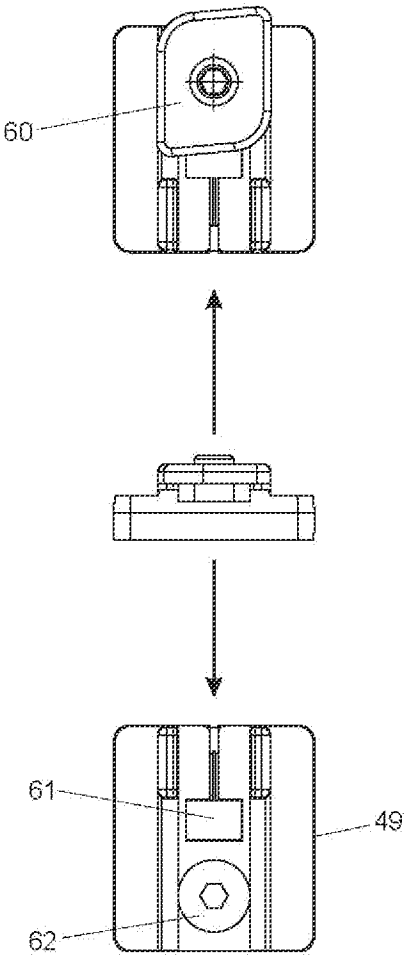
Figure 8A:
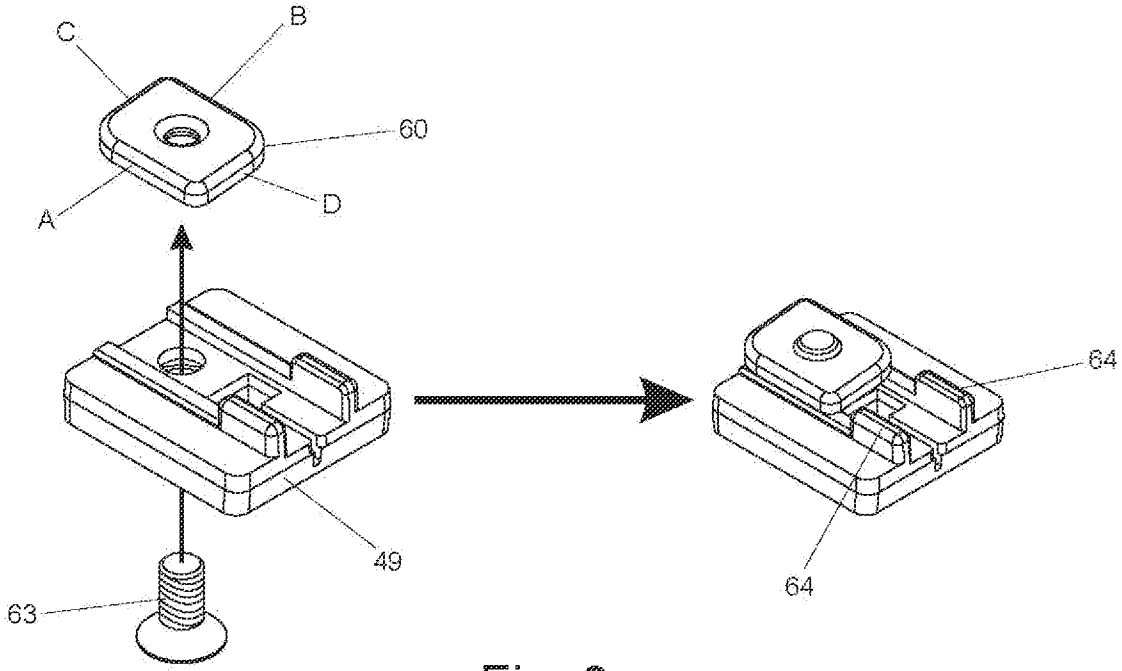

Each tension adjuster (49) (FIGS. 8*a*, 8*b*, 9*a*, 9*b*, 9*c*, and 9*d*) has a square through hole (61) and a through hole (62), through which a screw (63) passes from the lower part of the stretcher and on which a rhomboid butterfly nut is screwed (60). The butterfly nut (60) has two sides (A, B) larger than the other two (C, D), where the two smaller sides (C, D) have a smaller width than the width of the receptor (57) that the upper fixed guide (25) has, inside which the stretcher will be stabilized. The stretcher has on its upper surface two mountings (64) (FIGS. 8*a* and 8*b*).

All three components for the fastening of the ropes, the ropes' central run component (47) and the two tension adjusters (49) are placed all three inside the upper horizontal fixed guide (25) in the following mode (FIGS. 7*a*, 7*b*, 7*c*, 7*d*, 9*a*, 9*b*, 9*c*, and 9*d*):

The ropes' central run component (47) (FIG. 7) enters the upper guide (25) upwards, inside the socket (57) of the guide (25) (FIGS. 7*a*, 7*b*). The rhomboid butterfly nut (60) enters the socket (57) having its largest sides (A, B) parallel to the mountings (67) of the component. The parallel mountings (67) enter the respective grooves (66) of the upper guide (25) (FIG. 7*c*). By using a tool, such as an Allen, the screw is screwed (59) while the butterfly nut (60) turn and the whole run component (47) is stabilized in the socket (57) of the upper guide (25) (FIG. 7*c*, 7*d*).

Each tension adjuster (49) enters the upper guide (25) upwards, inside the socket (57) of the guide (25). The rhomboid butterfly nut (60) enters the socket (57) having the large sides (A, B) in a straight line with the mountings (64) (FIGS. 9*a*, 9*b*, 9*c*, and 9*d*). The butterfly nut (60) enters the socket (57) of the guide (FIG. 9*c*). By using a tool, such as an Allen, the screw is screwed (59) while the butterfly nut (60) turn and the whole run component (49) is stabilized in the socket (57) of the upper guide (25) (FIG. 9*c*, 9*d*).

FIGS. 10*a*, 10*b*, 10*c*, and 10*d* illustrate the connection of the ropes with the three ropes' stabilization components: ropes' central run component (47) and two tension adjusters (49). After the ropes having passed through the three components and having stabilized in them (FIG. 10*a*), then, as described above, first the central ropes' run component (47) and then the two stretchers on both sides (FIGS. 10*b*, 10*c*) enter inside the socket (57) of the upper guide (25) and are fastened. Thus, the ropes are stretched as much as needed.

The ropes' central end component (51) is at the same vertical line with the ropes' run component (47). The sliding guides enter and stop inside the grooves of the ropes' central end component (51) and the run component (47).

The ropes' central end components (51), the tension adjusters (49) and the run component (47) function all together, never in an autonomous way.

As illustrated in FIGS. 14*a* and 14*b*, the autonomous anti-mosquito system with the one-sided opening of FIG. 1, is semi-assemblies as a kit (FIG. 14*a*) and after being cut at dimensions equal to the height of the opening, it is assembled on the spot (FIG. 14*b*).

The invention functions exactly in the same way if instead of a wire rope another strong rope is used.

The invention is implemented on all anti-mosquito nets with pleated net and horizontal movement and have a fixed horizontal guide at the bottom.

The invention claimed is:

1. An autonomous anti-mosquito net system, comprising:

an upper fixed horizontal guide;

a lower fixed horizontal guide;

a retention guide comprising a first plurality of trucks;

a sliding case comprising a second plurality of trucks, the sliding case having a detachable upper edge and a detachable lower edge, the detachable upper edge having at least two pulleys, and the detachable lower edge having at least one pulley, the at least two pulleys on the detachable upper edge, and the at least one pulley on the detachable lower edge being arranged to rotate about respective horizontal axes;

a fixed side guide having an upper adjustable anchor point and a lower adjustable anchor point;

a pleated net extending between the retention guide and the sliding case;

a plurality of ropes connected between the first and second pluralities of trucks, the plurality of ropes extending horizontally through the pleated net and meeting to form a bundle along the sliding case, the bundle extending upwards along the sliding case towards the upper fixed horizontal guide, passing over one of the at least two pulleys on the detachable upper edge, extending at least partially along the upper fixed horizontal guide, and anchored onto the upper adjustable anchor point on the fixed side guide; and at least one wire rope connected to the retention guide and extending along the upper fixed horizontal guide, the at least one wire rope passing over the other of the at least two pulleys on the detachable upper edge, extending downward along the sliding case, passing around the at least one pulley on the detachable lower edge, extending along the lower fixed horizontal guide and a portion of the fixed side guide, the at least one wire rope being connected to the lower adjustable anchor point of the fixed side guide.

2. The autonomous anti-mosquito net system of claim 1, further comprising an opening formed in the detachable upper edge adjacent one of the at least two pulleys, wherein the wire rope extends through the opening.

3. The autonomous anti-mosquito net system of claim 1, wherein the fixed side guide includes a detachable upper edge with an opening disposed at one end, and a detachable lower edge with an additional opening disposed at another end, wherein the plurality of ropes forming the bundle extends through the opening in the detachable upper edge of the fixed side guide, and wherein the wire rope extends through the opening in the detachable lower edge of the fixed side guide.

4. The autonomous anti-mosquito system of claim 1, further comprising:

at least two leaves, each of the at least two leaves having at least one respective sliding case;

wherein the upper fixed horizontal guide includes a socket and two grooves;

end components disposed within the upper fixed horizontal guide, the end components including a run component, and two tension adjusters, wherein the run component forms two square through holes through which the bundle of the plurality of ropes passes, further comprising a rhomboid butterfly nut fastened onto the run component;

wherein each of the two tension adjusters includes a square through hole where an end of the bundle is fastened, and a second through hole, in which an additional rhomboid butterfly nut is secured;

wherein each of the rhomboid butterfly nuts has two sides that are larger than two remaining sides;

wherein the end components and a portion of the bundle of the plurality of ropes are disposed within the upper horizontal guide in alignment with the rhomboid butterfly nuts; and an H-shaped component, wherein the H-shaped component forms a central fastening hole, two stretching holes into which the wire rope is secured, and two holes into which the bundle is secured, wherein the H-shaped component further includes grooves for accommodating ends of the sliding case.

* * * * *